US009846007B2

(12) United States Patent
Young et al.

(10) Patent No.: US 9,846,007 B2
(45) Date of Patent: Dec. 19, 2017

(54) FIREARM DISCHARGE RECORDING AND REPORTING SYSTEM

(71) Applicant: Young, Jack & Wright, Inc., New Palestine, IN (US)

(72) Inventors: Donald J. Young, Bloomington, IN (US); Jamon Jack, New Palestine, IN (US); Thomas L. Wright, Morristown, IN (US)

(73) Assignee: Young, Jack & Wright, Inc., New Palestine, IN (US)

( * ) Notice: Subject to any disclaimer, the term of this patent is extended or adjusted under 35 U.S.C. 154(b) by 0 days.

(21) Appl. No.: 15/053,005

(22) Filed: Feb. 25, 2016

(65) Prior Publication Data

US 2017/0248388 A1 Aug. 31, 2017

(51) Int. Cl.

| | |
|---|---|
| ***F41C 27/00*** | (2006.01) |
| ***H04L 29/08*** | (2006.01) |
| ***F41C 33/02*** | (2006.01) |

(52) U.S. Cl.

CPC ..... *F41C 27/00* (2013.01); *F41C 33/029* (2013.01); *H04L 67/12* (2013.01)

(58) Field of Classification Search

CPC .... F41C 27/00; F41C 33/029; F41C 33/0254; F41A 19/01; H04L 67/12

USPC ..... 42/1.01, 1.02, 1.03, 84

See application file for complete search history.

(56) References Cited

U.S. PATENT DOCUMENTS

| | | | |
|---|---|---|---|
| 4,541,191 | A | 9/1985 | Morris et al. |
| 5,479,149 | A | 12/1995 | Pike |
| 6,099,147 | A | 8/2000 | Ziegenfuss |
| 6,363,223 | B1 | 3/2002 | Gordon |
| 6,491,409 | B1 | 12/2002 | Sharrah et al. |
| D481,816 | S | 11/2003 | Sharrah et al. |
| D521,170 | S | 5/2006 | Craft et al. |
| D527,476 | S | 8/2006 | Craft |
| 7,093,954 | B2 | 8/2006 | Sharrah et al. |
| 7,188,978 | B2 | 3/2007 | Sharrah et al. |
| 7,199,315 | B1 | 4/2007 | Sharrah et al. |
| D543,446 | S | 5/2007 | DiNenna |

(Continued)

OTHER PUBLICATIONS

328LMF-A; LED WeaponLight for H&K MP5, HK53, HK94-1 Battery, 1 Switch.

(Continued)

*Primary Examiner* — Joshua Freeman

(74) *Attorney, Agent, or Firm* — Woodard, Emhardt, Moriarty, McNett & Henry LLP

(57) ABSTRACT

A monitoring apparatus and system for recording, differentiating, and reporting the discharge of firearms. The monitoring apparatus can be mounted to a firearm and may be automatically activated when the firearm is drawn from a holster thus enabling the monitoring apparatus to record information such as sound, video, location, time, and the like. The apparatus may use this information to differentiate between shots fired by the firearm and shots fired by other firearms. The device may report this distinction to a remote computer configured to receive updates from the weapon mounted apparatus in real time. The remote computer may display the information on a user interface such as a map display, and/or distribute the information according to rules defining how the information should be processed.

20 Claims, 7 Drawing Sheets

(56) References Cited

U.S. PATENT DOCUMENTS

| | | | | |
|---|---|---|---|---|
| D548,385 | S | 8/2007 | Sharrah et al. | |
| D568,508 | S | 5/2008 | Howe et al. | |
| D585,516 | S | 1/2009 | Smith | |
| 7,614,760 | B2 | 11/2009 | Sharrah et al. | |
| D628,323 | S | 11/2010 | Matthews et al. | |
| D628,324 | S | 11/2010 | Matthews et al. | |
| 8,069,605 | B2 * | 12/2011 | Fressola | F41H 13/0025 33/266 |
| 8,117,778 | B2 * | 2/2012 | Clark | F41A 19/01 42/1.01 |
| 8,226,267 | B2 | 7/2012 | Sharrah et al. | |
| 8,287,157 | B2 | 10/2012 | Sharrah et al. | |
| D674,525 | S | 1/2013 | Sharrah et al. | |
| 8,371,729 | B2 | 2/2013 | Sharrah et al. | |
| 8,531,526 | B1 | 9/2013 | Spence et al. | |
| D709,158 | S | 7/2014 | Wells | |
| 8,998,084 | B2 | 4/2015 | McIntyre | |
| 9,004,726 | B2 | 4/2015 | Vasylyev | |
| 9,057,580 | B2 | 6/2015 | Rorick et al. | |
| 9,062,933 | B1 | 6/2015 | Allen et al. | |
| 2010/0324859 | A1 * | 12/2010 | McNelis | F41A 19/01 702/150 |
| 2011/0119979 | A1 * | 5/2011 | Gussalli Beretta | F41A 19/01 42/1.02 |
| 2012/0055061 | A1 * | 3/2012 | Hartley | F41C 23/16 42/84 |
| 2012/0151814 | A1 * | 6/2012 | Dietel | F41A 11/02 42/84 |
| 2013/0182423 | A1 | 7/2013 | Matthews et al. | |
| 2013/0219762 | A1 * | 8/2013 | Delgado Acarreta | F41C 27/00 42/1.03 |
| 2013/0308323 | A1 | 11/2013 | Jigamian et al. | |
| 2014/0036354 | A1 | 2/2014 | Jigamian | |
| 2014/0378088 | A1 * | 12/2014 | Goel | F41A 17/063 455/404.2 |
| 2015/0000169 | A1 * | 1/2015 | Righi | F41A 17/00 42/1.01 |
| 2015/0176937 | A1 * | 6/2015 | Sullivan | F41A 17/063 42/84 |
| 2015/0198406 | A1 * | 7/2015 | Ling | F41G 11/003 42/90 |
| 2015/0369554 | A1 * | 12/2015 | Kramer | F41A 17/063 386/227 |
| 2016/0033221 | A1 * | 2/2016 | Schmehl | F41A 33/00 42/90 |

OTHER PUBLICATIONS

ATN Shot Trak HD Action Gun Camera; Sportman's Guide.
DSF-870; Ultra-High Two-Output-Mode LED WeaponLight for Remington 870.
Gun Camera; Police Weapons; The Law Enforcement Magazine.
GunCam Bundle; Tachyon Web Site.
Pistol-Cam Made in Keeseville; WCAX.com Web Site.
RAID Weapon Lights.
Scout Light Weapon Lights.
ShotKam Web Site.
Tactical Gun Mount.
TLR-1 HL High Lumen Rail Mounted Strobing Tactical Light; Streamlight, Document #259 Issued Oct. 29, 2012 and Revised Dec. 11, 2012.
X300 Ultra; Led Handgun or Long Gun WeaponLight.
X400 Ultra-Red Laser; LED Handgun or Long Gun WeaponLight with Laser.
X400 VIRc White-Light/Infrared LED + Infrared Laser WeaponLight.
XC1; Ultra-Compact LED Handgun Light.
New Police Technology Offers Bird's Eye View, abcnews.go.com/GMA.

* cited by examiner

FIREARM DISCHARGE RECORDING AND REPORTING SYSTEM

SUMMARY

Disclosed is an apparatus and system for recording, differentiating, and reporting the discharge of firearms. The system includes a monitoring apparatus that can be mounted to a firearm (i.e. the "primary" firearm). This primary firearm may be a pistol, rifle, shotgun, or any other suitable firearm. The monitoring apparatus can operate as part of a larger system where gunshot-related information is collected, analyzed, and relayed to other systems, assets in the field, and/or administrators or other personnel. The weapon-mounted device may be automatically activated when the primary firearm is drawn thus enabling it to record sound, video, location, time, and other relevant information. The device may use this information to differentiate between shots fired by the primary firearm, or by some other firearm, and may then report these distinctions to a remote computer configured to receive updates from the weapon mounted apparatus in real time. This remote computer may be configured to display the information on a user interface such as a map display, and/or distribute the information according to rules defining how the information should be processed.

The monitoring apparatus may include an enclosure having a mount adapted and arranged to couple the enclosure to the primary firearm. For example, the monitoring apparatus mount may be coupled to a frame assembly of the primary firearm that may include a grip at a first end extending to a second end opposite the grip. A controller may be included within the enclosure, and a camera, microphone, and motion sensor may be positioned in the enclosure and operatively coupled to the controller. The controller may include control logic configured to determine that a first firearm has been discharged based on motion sensor input from the motion sensor, determine a second firearm has been discharged based on audio input from the microphone, and/or determine that the first firearm is the primary firearm based on the motion sensor input, and that the second firearm is not the primary firearm based on the audio input from the microphone. In this way the monitoring apparatus can distinguish between gunshots fired from the primary firearm versus gunshots fired by some other firearm (e.g. a firearm carried by another officer or an assailant).

The monitoring apparatus may be implemented to include other aspects and features. For example, the enclosure may optionally be a sealed enclosure, or the microphone may be mounted inside the enclosure and responsive to sound received from outside the enclosure. Similarly, the camera may be mounted inside the enclosure and arranged to define a field-of-view extending outside the enclosure. This field of view may be generally directed in substantially the same direction that projectiles travel in when discharged by the primary firearm. In another aspect, a proximity sensor may be included inside the enclosure that is adapted to be responsive to a sensor target in a holster configured to receive the primary firearm. A motion sensor may be included inside the enclosure and arranged to detect movement of the monitoring apparatus, and by extension, the primary firearm. This holster may be worn by an officer, mounted to a vehicle, mounted inside a safe or lockbox, or positioned in any other suitable location.

The controller may be mounted inside the enclosure and may include, or be configured to use or access, any suitable hardware or software aspects of the monitoring apparatus. For example, a network interface may be included in the enclosure and may be configured to send messages to a remote computer using communication links to a communications network such as the Internet. The remote computer may be coupled to the network via one or more communications links which may be wired, wireless, or any other suitable type of link. The controller may include or be coupled to the camera, microphone, proximity sensor, motion sensor, network interface, and/or transmitter, wherein the controller may also include control logic configured to activate the camera, microphone, and motion sensor when the proximity sensor senses the sensor target. The controller may also send a message to a remote computer using the network interface when the control logic determines that the first firearm discussed above is a different firearm than the second firearm. The control logic may optionally be configured to send a second different report message to the remote computer (using the network interface) when the control logic determines that the first firearm and the second firearm are the primary firearm.

In another aspect, the monitoring apparatus may include a memory inside the enclosure, and a port coupled to the controller that is configured to establish or accept a communications link coupled to the remote computer. The control logic in the monitoring apparatus may be configured to store one or more images received from the camera into the memory, and perhaps also to transfer at least a portion of the images received in the memory to the remote computer by sending one or more messages to the remote computer using a communications link.

In another aspect, the monitoring apparatus may include a location sensing device inside the sealed enclosure that may be in communication with the control logic. The location sensing device may be configured to determine a location of the monitoring apparatus, and by extension the primary firearm. Control logic in the monitoring apparatus may be configured to send one or more messages to a remote computer that include the location of the primary firearm, such as when the camera is activated, when a gunshot is detected, and/or when the gunshot detected is the primary firearm, or some other firearm.

In another aspect, the monitoring apparatus may include one or more lamps or other light source inside the sealed enclosure. The lamp may be mounted in the enclosure and arranged to project light outside the enclosure. For example, the lamp may be configured so that at least a portion of the light projected by the lamp is projected into the field of view of the camera. The lamp or lamps may include light sources emitting light visible to the naked eye, light that is not visible to the naked eye (e.g. infra-red light), or any useful combination thereof. The lamp(s) may be configured to emit light when a switch in the monitoring apparatus is actuated from an off to an on position, by control logic configured to automatically activate the lamps when the primary weapon is removed from the holster where the ambient light is below a predetermined target threshold intensity (as measured by a the camera, or by another light sensor in the monitoring apparatus), or by any suitable combination thereof.

In another aspect, the proximity sensor in the enclosure is responsive to the sensor target in the holster, and the control logic in the monitoring apparatus is configured to activate the camera, microphone, and motion sensor when the proximity sensor senses the sensor target as the primary firearm is removed from the holster, and to deactivate the camera, microphone, and motion sensor when the proximity sensor senses the sensor target as the primary firearm is placed in the holster.

In another aspect, the monitoring apparatus can include a communications port coupled to or included in the controller that is configured to communicate with the remote computer, and/or a power port configured to receive power from outside the enclosure such as to charge a battery in the sealed enclosure that is used to power the monitoring apparatus. The power port may be configured to receive a cable configured to carry power to the monitoring apparatus, or it may be configured to receive power without a cable such as via electrical or magnetic waves, or any combination thereof, in a time varying field passing through the enclosure and received by the power port. In another aspect, the communications port and the power port may be the same port, such as a Universal Serial Bus (USB) port, or wireless structures such as a Near Field Communication (NFC) antenna array, or other suitable wireless devices adapted to transfer power and data. This transfer may occur, for example, when the monitoring device is returned to a docking station or other maintenance device configured to receive the monitoring device and facilitate data down load and recharging. The record of events may thus be maintained while reducing or eliminating the risk of the record being destroyed or tampered with.

In operation, the system may determine that the primary firearm has been withdrawn from the holster using the proximity sensor coupled to the controller. The proximity sensor may be mounted to the primary firearm (e.g. in the monitoring apparatus), and the sensor target may be mounted to the holster. When the proximity sensor passes adjacent to the sensor target, the proximity sensor can send a signal to the controller thus indicating the firearm is being withdrawn from the holster.

When the controller determines the firearm has been withdrawn, the controller may activate the camera, microphone, and motion sensor, or any other control logic or sensors that may be useful for detecting and reporting gunshots. The camera can also begin storing one or more frames or images to the memory as directed by the controller. The controller may also direct the monitoring apparatus to transfer images from the memory to a remote computer by sending the data, or messages containing at least a portion of the data, to the remote using a communications link. This transfer may occur when the monitoring apparatus is connected to a the remote computer via the power or communications ports after the monitoring apparatus has been returned to the maintenance device, or in real time via wireless communications link such as over the cellular network.

The controller may determine that a firearm has been discharged based on input to the controller that is received from the motion sensor. This may occur, for example, when the primary firearm is discharged causing the weapon to "recoil" and/or the barrel to rise abruptly resulting in rapid changes in position, velocity, and/or acceleration that may be detected by the motion sensor and differentiated from movements that are not related to a discharge (e.g. the weapon being dropped onto a hard surface or thrown). The controller may also determine that a second firearm has been discharged based on input received from the microphone. Gunshots can, and generally do, result in some changes in air pressure to move outwardly away from the discharged firearm in all directions, and other air pressure changes caused by high-speed flight of the projectile passing through the air. At least some of these changes in air pressure can be detected by microphones in the monitoring apparatus coupled to the primary firearm and passed as electrical signals to the controller for processing.

Based on the time varying input from at least the motion sensor and the audio sensors, the controller can determine whether first firearm and the second firearm are the same weapon, different weapons, and/or whether or not either of the first and second firearms is the primary firearm. This information can then be sent via a message to the remote computer using a communications link between the controller and the remote computer.

In another aspect, the location sensing system mounted to the primary firearm may automatically sense a location of the primary firearm using the controller, a process that may occur any time the monitoring apparatus is operational and mounted to the primary firearm, or may begin automatically when the primary firearm is withdrawn from the holster, and may end when the firearm is placed back into the holster. The controller may accept this location information from the location sensing system send at least a portion of the location information as individual updates messages, or along with any other message sent to the remote computer. For example, when the primary firearm is withdrawn from the holster, the controller may automatically begin sending location updates to a remote computer via a communications link (e.g. Wifi or cellular link). The location information may also be sent along with a message indicating that some other firearm (not the primary firearm) has discharged, it may be sent with a message indicating that the primary firearm has discharged, or with any other message or data communication with the remote computer.

Messages, data, location updates, or any other communications from a monitoring apparatus may be received by a remote computer having any suitable arrangement of software and hardware useful for displaying, storing, and/or disseminating information about the discharge of firearms. For example, the computer may have a communications module configured to maintain communications links with one or more monitoring apparatuses. In another example, the remote computer may have a geo-location module configured to process the location information received by the remote computer from the monitoring apparatuses. The remote computer may include user interface module configured to generate a user interface with a map and indicia on the map indicating the location of the primary firearm, and any other firearms that may be reporting gunshots. Indicia indicating the approximate or exact location of other firearms may be displayed as well.

Further forms, objects, features, aspects, benefits, advantages, and examples of the concepts summarized above are described in further detail in the description, claims, and drawings provided herewith.

DETAILED DESCRIPTION

Figure 1B:
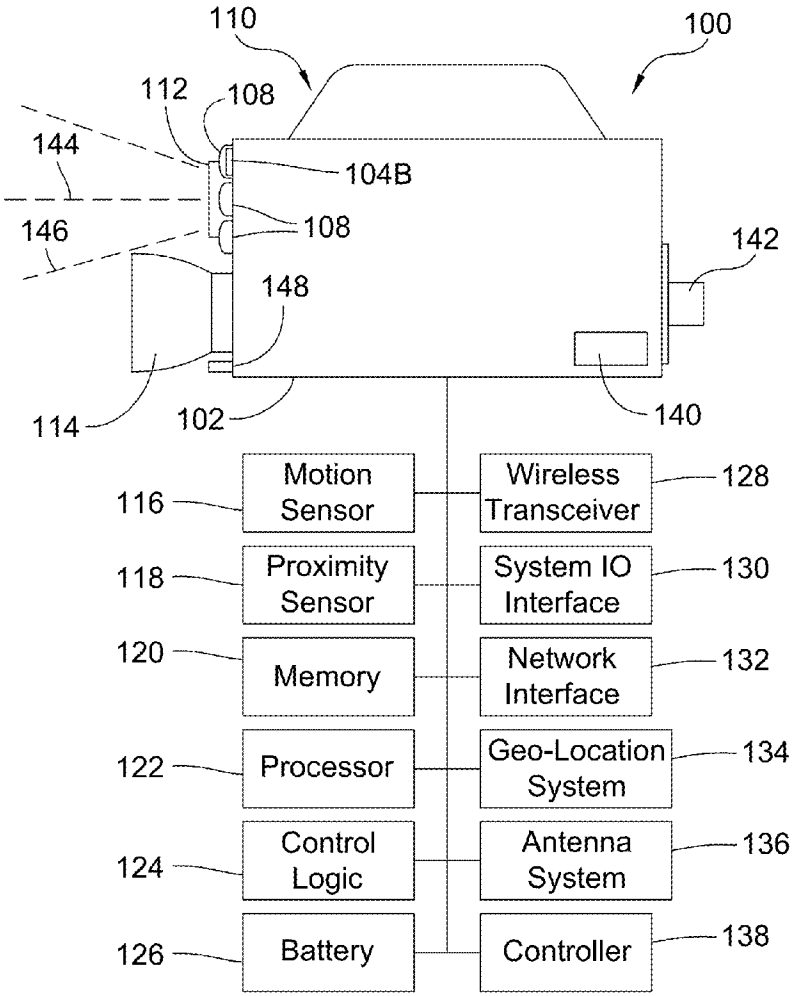
FIG. 1B is a diagram illustrating additional components of the monitoring apparatus of FIG. 1A.

With respect to the organization and description of figures, the reference numerals in the detailed description are organized to aid the reader in quickly identifying the drawings where various components are first shown. In particular, the drawing in which an element first appears is typically indicated by the left-most digit(s) in the corresponding reference number. For example, an element identified by a "100" series reference numeral will first appear in FIG. 1, an element identified by a "200" series reference numeral will first appear in FIG. 2, and so on.

Figure 1A:
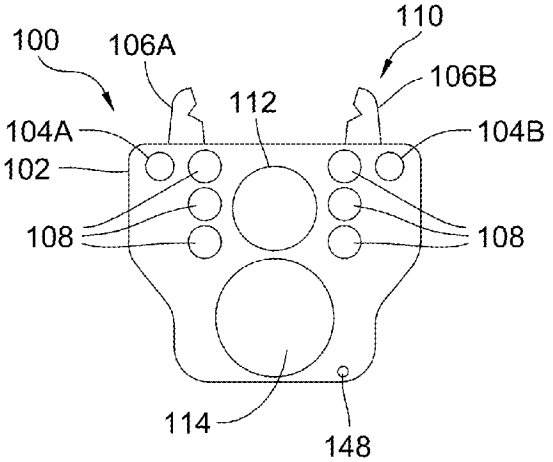
FIG. 1A is a diagram illustrating components of one example of a monitoring apparatus according to the present disclosure.

Beginning with the recording and reporting apparatus that may be attached to a firearm, one example appears at 100 in FIGS. 1A and 1B. As discussed in further detail herein elsewhere, unit 100 may be operated as part of a larger weapons discharge reporting and monitoring system configured to accept input from multiple units like unit 100.

Unit 100 may include one or more microphones such as microphones 104A and 104B which may be mounted within an enclosure 102. Microphones 104 may be positioned inside the enclosure 102 and may be arranged to be responsive to sound received from outside the enclosure, such as sound generated by the discharge of a firearm. To aid in audio capture, and/or in determining the direction sound energy is received from, microphones 104 may be positioned on opposite sides of a camera 112.

Camera 112 may be configured as a video camera capturing a continuous series of images or frames, a still camera capturing individual images, or any other suitable camera. Camera 112 may be mounted inside enclosure 102 and may be positioned to have a field-of-view that extends outside the enclosure. For example, camera 112 may be arranged with a central viewing axis 144 that can be configured to extend substantially parallel to the barrel of a firearm to which camera 112 may be attached. The camera may be oriented such that a field of view 146 extends away from the frame or handle portion of the firearm thus positioning field of view 146 so that camera 112 may capture images of events taking place in the direction the firearm is pointed.

Camera 112 may also be configured to operate in low light or at night, a feature which may be enhanced by one or more light sources that may project visible or invisible light. For example, light sources 108 may be configured to emit light that is not visible to the naked eye such as infrared light which may be captured by camera 112 when recording images in low light or total darkness. Image capture by camera 112 (and perhaps overall visibility for the operator) may also be enhanced by a visible light source 114, one example of which is a flashlight. Light source 114 may be activated automatically when unit 100 begins to record images, audio, movement, etc., or it may be manually activated by the operator such as by actuating a switching device 142 such as a toggle or momentary switch.

Figure 2:
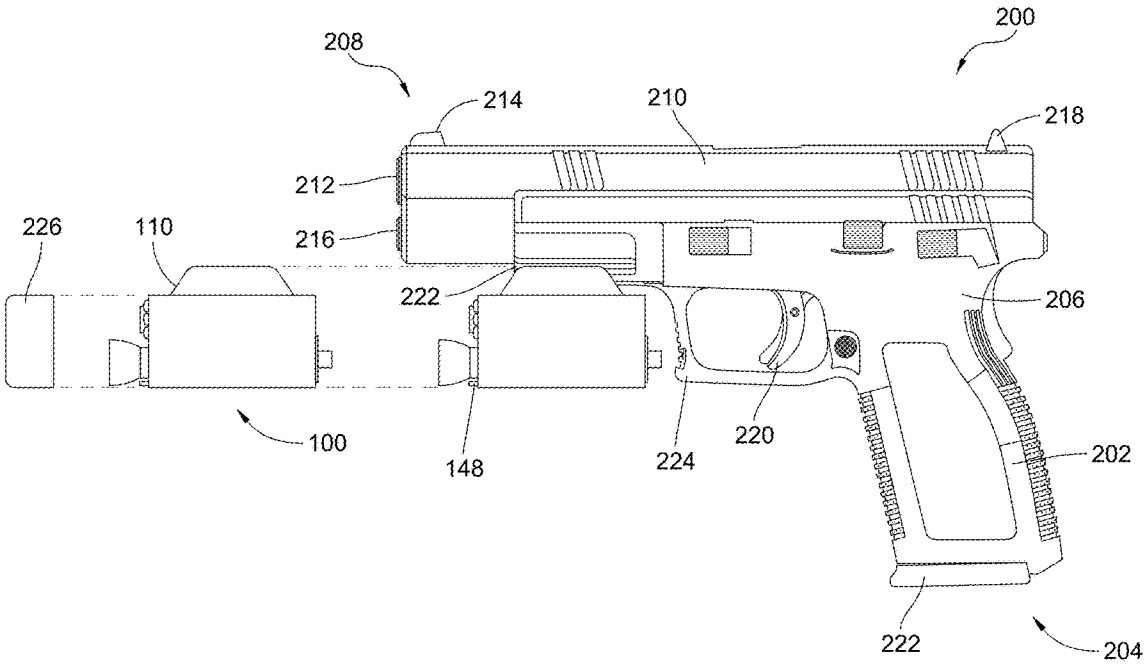
FIG. 2 is a diagram illustrating one way the monitoring device of the preceding figures may be coupled to a firearm.

Unit 100 may optionally include a switch 148 that may be actuated by the presence or absence of a cover positioned over unit 100 (See example in FIG. 2). Switch 148 is shown extending outwardly away from unit 100 in the direction of camera 112, and may be actuated by depressing the outwardly extending member partially or completely into unit 100. FIG. 1B is merely illustrative in this regard as switch 148 may be actuated by any suitable means. For example, switch 148 may be mounted in an indention or hole in unit 100 and actuated by a member projecting toward unit 100 from a cap or cover placed over the unit. In another example, switch 148 may include a proximity sensor within unit 100 adjacent to the cover when the cover is in place, and responsive to the presence of an activation device such as a magnet in the cover.

Unit 100 may be mounted to a firearm by any suitable means such as by a mounting assembly 110 which may have one or more arms 106. Arms 106A and 106B may be of any suitable type, and may be arranged and configured to couple the weapon mounted unit 100 in any suitable position. One non-limiting example of a commercially available bracket or rail system that may be configured to receive arms 106 is the "Picatinny rail," also known as a MIL-STD-1913 rail, Standardization Agreement 2324 rail, or more generally as a "tactical rail."

FIG. 1B illustrates additional aspects that may be included in monitoring unit. For example, unit 100 may include a controller 138 configured to control the recording, reporting, and other functional aspects of unit 100. Motion sensor 116, may also be included in, or coupled to controller 138. Motion sensor 116 may be configured to generate an electrical signal when unit 100 is moved in one or more axes of movement such as up and down, left and right, forward and backwards, or any combination thereof. Motion sensor 116 may include multiple accelerometers arranged to detect vibrations or movement of unit 100, such as when unit 100 is moves or vibrates as a result of recoil caused by the discharge of the firearm unit 100 may be attached to.

Controller 138 may be responsive to signals from a proximity sensor 118 which may be configured to generate such electrical signals when sensor 118 passes adjacent to a sensor target that is within a predetermined detection range. Sensor 118 may be arranged and configured to generate signals in response to a sensed parameter such as a magnetic field, electrical field, and the like. A sensor target may thus trigger sensor 118 without physically contacting it.

Controller 138 may include or have access to a memory 120, processor 122, and control logic 124. Memory 120 may be useful for storing images, operating parameters, logic rules and the like. Processor 122 may be configured or programmed by software to perform any of the operations performed by controller 138 such as logical, control, or processing functions discussed herein. Control logic 124 may be included with, or accessed by, controller 138 and programmed to configure processor 122 or other circuits in controller 138 to make any of the various logical decisions discussed herein.

A wireless transceiver 128 may also be included and configured to enable wireless communication between unit 100 and other wireless transceivers within range of unit 100. A network interface 132 may be included and configured to interact with wired or wireless networks, storage systems, computers, and the like. For example, network interface 132 may interact with wireless transceiver 128 to establish wireless communications links for sending or receiving data and for notifying remote systems or computers of events such as the discharge of a firearm.

A geolocation system 134 may also be included and may be configured to determine a location of unit 100. Geolocation system 134 may use satellites such as Global Positioning Satellites (GPS), cellular networks, networking protocols, or any other suitable means to determine the location of unit 100. An antenna system 136 may also be included to facilitate communication with other radio receivers and transmitters such as those used by wireless transceiver 128. Antennas which may be part of antenna system 136 may be of any suitable type such as coils of wire are strips of metal within unit 100, embedded in enclosure 102, or fixed to the exterior of enclosure 102.

A system input output interface 130 may be included and configured to manage input and output with internal devices such as motion sensor 116, proximity sensor 118, and wireless transceiver 128, geolocation system 134, and the like. Input and output with external devices that may interact with unit 100 may be managed by interface 130 as well. External devices may include remote computers, maintenance devices, charging stations, and the like.

Power for the devices in unit 100 may be supplied by a battery 126. Any suitable type of battery may be used, such as a lithium-ion rechargeable battery. Battery 126 may be recharged by connecting a power, or other similar cable to a port 140. Port 140 may pass through the enclosure 102 allowing unit 100 to be easily recharged by attaching a charging or data cable to port 140. Port 140 may also be used for transferring image files or other data files from memory 120 when the data or charging cable is used to couple port 140 to another computer.

Port 140 may be configured in any suitable fashion and may not require a physical cable connection to transfer power and/or data files. For example, power may be transferred through a port 140 using radiated electromagnetic energy, or using a time varying magnetic field. In another example, wireless transceiver 128 may be used to transfer data files without the need for a physical cable connection. In another example, wireless transfer of power and data files may be implemented by a port 140 that includes a physical connection such as a USB port, and a wireless connection such as a connection implemented using a NFC devices thus providing multiple options for transferring data and charging battery 126.

Using memory 120, processor 122, and any other circuits or control systems, controller 122 may be configured to execute control logic, process images, activate camera 112, microphones 104, motion sensor 116, and/or proximity sensor 118. It may operate to determine when a firearm has been discharged based on signals from motion sensor 116, or based on audio input from microphones 104. Controller 138 may be configured to send a message to a remote computer using network interface 132 when control logic 124 determines that the firearm unit 100 is mounted to has discharged, or that some other firearm has discharged, or both. For example, controller 138 may be configured to distinguish between the discharge of one firearm versus another by processing signals from motion sensor 116 and audio input from microphones 104. Such processing may be performed by processor 122 configured to compare time-varying input from microphones 104, motion sensor 116, and possibly other sensors as well using control logic 124.

Microphones 104 may, for example, be configured to detect sound energy generated by the discharge of any firearm within the detection range of the microphones—including the firearm the monitoring device is coupled to. Motion sensor 116 may be configured to detect discharge of the firearm unit 100 is coupled to based on movement of the firearm resulting from abrupt movement of the weapon. Signals from at least these two sensors may be compared by control logic 124 using processor 122 or other circuits in controller 138. For example, if audio and motion sensor input is detected and passed to the controller 138 at about the same time, controller 138 may determine that the firearm the monitoring device is attached to has been fired. In another example, if audio input is passed to the controller 138, controller 138 may determine that a firearm that is not the primary firearm has discharged and may report the discharge accordingly. The control logic 124 thus may be configured to distinguish a discharge of the primary firearm from the discharge of another firearm based on audio input received at a first time, and motion sensor input received at a second time that is either earlier or later than the first time by some predetermined threshold or target.

For example, it may be determined by experimentation that the discharge of a particular firearm to which unit 100 is mounted may not be registered via microphones 104 until about 1.5 ten thousandths of a second after the firearm has actually discharged. It may also be determined by experimentation that the same firearm may experience recoil velocity of about 20 feet per second. Thus microphones 104 may register the audible report after motion sensors 116 register a change in movement that is determined to be a gunshot, or before, or at about the same time.

Controller 138 may determine that a gunshot has occurred by comparing the time-varying signal received from microphones 104. For example, controller 138 may analyze the signals from microphones 104 comparing the signals to acoustic signatures stored in memory 120. The controller may determine a gunshot has occurred when a received signal from microphones 104 matches an acoustic signature for the air pressure changes caused by the bow shockwave of a projectile as it passes through the air, or by the acoustic signature that results from pressure waves caused by expanding gasses leaving the barrel of the discharged firearm.

In another aspect, controller 138 may determine a gunshot has occurred by comparing the time-varying signals received from motion sensor 116. Motion sensor 116 may be configured to send signals representing various aspects of the movement associated with a firearm before, during, and after it discharges. For example, motion sensor 116 may detect and report signals representing the recoil of the firearm which generally refers to the transfer of energy and momentum from the propellant to the cartridge case to the firearm breach and then finally into the hand, arm, or mount. This impulse in the opposite direction of the projectile being expelled is generally only applied for the length of time that the projectile remains in the firearm barrel (e.g. for about 1 millisecond). The timing of this rearward impulse, its magnitude, or both, may be compared with acceleration, momentum, or other signatures stored in memory 120 to detect a discharge.

In another example, motion sensor 116 may be configured to detect and send signals defining the muzzle lift experienced by the discharging firearm. For example, while the projectile is moving forward but still within the barrel of the firearm, the rearward pressure of the shell casing on the breach of the firearm pushes the firearm backwards into the mount or the hand of the operator. In many instances, the center of mass of the discharging firearm may be below the plane of the barrel which can result in a rotational force around the center of mass of the firearm. This rotational force may be detected by motion sensor 116 as "muzzle lift." The timing, magnitude, and perhaps other properties of this rotational impulse, may be compared with acceleration, angular momentum, or other signatures stored in memory 120. Thus recoil, muzzle lift, sound, and possibly other properties of a gunshot may be employed to assist unit 100 in detecting and differentiating gun shots.

FIG. 2 illustrates one possible configuration of unit 100 used in conjunction with a firearm 200. Firearm 200 is illustrated as a semi-automatic handgun. However, unit 100 may be configured for use with any firearm. As illustrated, firearm 200 has a frame assembly 206, and a slide assembly 210. Frame assembly 206 includes a grip section 202 at a first end 204 of firearm 200. A magazine 222 may be recessed into grip section 202 allowing bullets to be fed into a firing chamber within slide assembly 210. Frame assembly 206 may include a trigger guard 224 and a trigger 220 operable to activate firing mechanism within frame 206 and slide assembly 210. Slide assembly 210 may include a rear sight 218 and a front sight 214 as well as a barrel 212 from which bullets or other projectiles may be discharged. In this example, the muzzle or extreme end of barrel 212 is at a second end 208 of firearm 200 which is opposite first end 204. A front sight 214 may also be at or near second end 208. A guide rod 216 may also be included in slide assembly 210.

Frame assembly 206 may also include a mount or rail 222 configured and arranged to couple unit 100 to firearm 200. Mount 222 may be between first end 204 and second end 208, such as at about the second end 208. Mount 222 may be configured to accept rails 106 of mounting assembly 110 thus coupling monitoring assembly 100 to firearm 200. Mounting monitoring unit 100 at about the second end 208 may improve the sensitivity of motion sensor 116 making it easier to distinguish movement like recoil and muzzle lift from movements made while running or jumping, or movements that might occur if firearm 200 is dropped or thrown. In this way, motion sensor 116 may be less likely to register false positives (i.e. report that firearm 200 has discharged when it had actually has not). Mounting unit 100 as illustrated also provides a clear field-of-view for camera 112 in the area "down range" or "ahead of" firearm 200—which is to say the area into which a bullet will travel if fired from firearm 200. Thus actions taken by the operator when using firearm 200 may be recorded by camera 112, microphones 104, and by other sensors in unit 100 without being obstructed by firearm 200 itself, by the operator, or by other objects carried or used by the operator (e.g. a hand-held flashlight held in the operator's other hand). Such actions that may be recorded include the direction firearm 200 is pointed (e.g. an angle relative to a fixed point such as a compass heading), changes in speed or acceleration (e.g. gun is moving, not moving, and/or suddenly dropped), sounds occurring to the left, right, behind, and in front of unit 100, and activities occurring in the camera sensor's field of view that are recordable by reflected visible light, or by other means (such as by reflected infrared light) to name a few non-limiting examples.

As discussed above with regard to switch 148 in FIGS. 1A and 1B, unit 100 may optionally include a cover 226 which may be mounted to and/or removably coupled from unit 100. Cover 226 may be arranged and configured to partially or completely enclose components in unit 100 such as camera 112, light sources 108 and 114, and/or microphones 104. Cover 226 may operate as a safety cover protecting camera 112, light sources 108, and/or microphones 104 during storage, transportation, or when unit 100 is mounted to firearm 200, but recording and reporting activities are unnecessary (e.g. when the firearm is used for practice at a gun range). The presence or absence of cover 226 may actuate switch 148 which may signal logic in controller 138 to activate or deactivate unit 100, move unit 100 into or out of a "stand by" mode, and the like. For example, switch 148 may be configured to signal controller 138 to activate unit 100 (e.g. begin recording audio and video, begin reporting events, and the like) when cover 226 is removed, and to deactivate unit 100 when cover 226 is replaced. This can be useful in some cases such as where firearm 200 is secured in a rack or mount and/or where unit 100 is not configured to activate by simply removing the firearm from the mount.

In another example, switch 148 may be configured to signal controller 138 to place unit 100 in a standby mode when cover 226 is removed from unit 100 making the unit ready to begin recording if activated. Such activation may occur, for example, by actuating switching device 142, or by signals received from proximity sensor 118. For example, cover 226 may be removed and firearm 200 placed in a holster. This combination of activities may signal the controller 138 to put unit 100 in standby mode, activating its recording and reporting functions only when the firearm is removed from the holster, and deactivating these function when the firearm is replaced in the holster.

Figure 3:
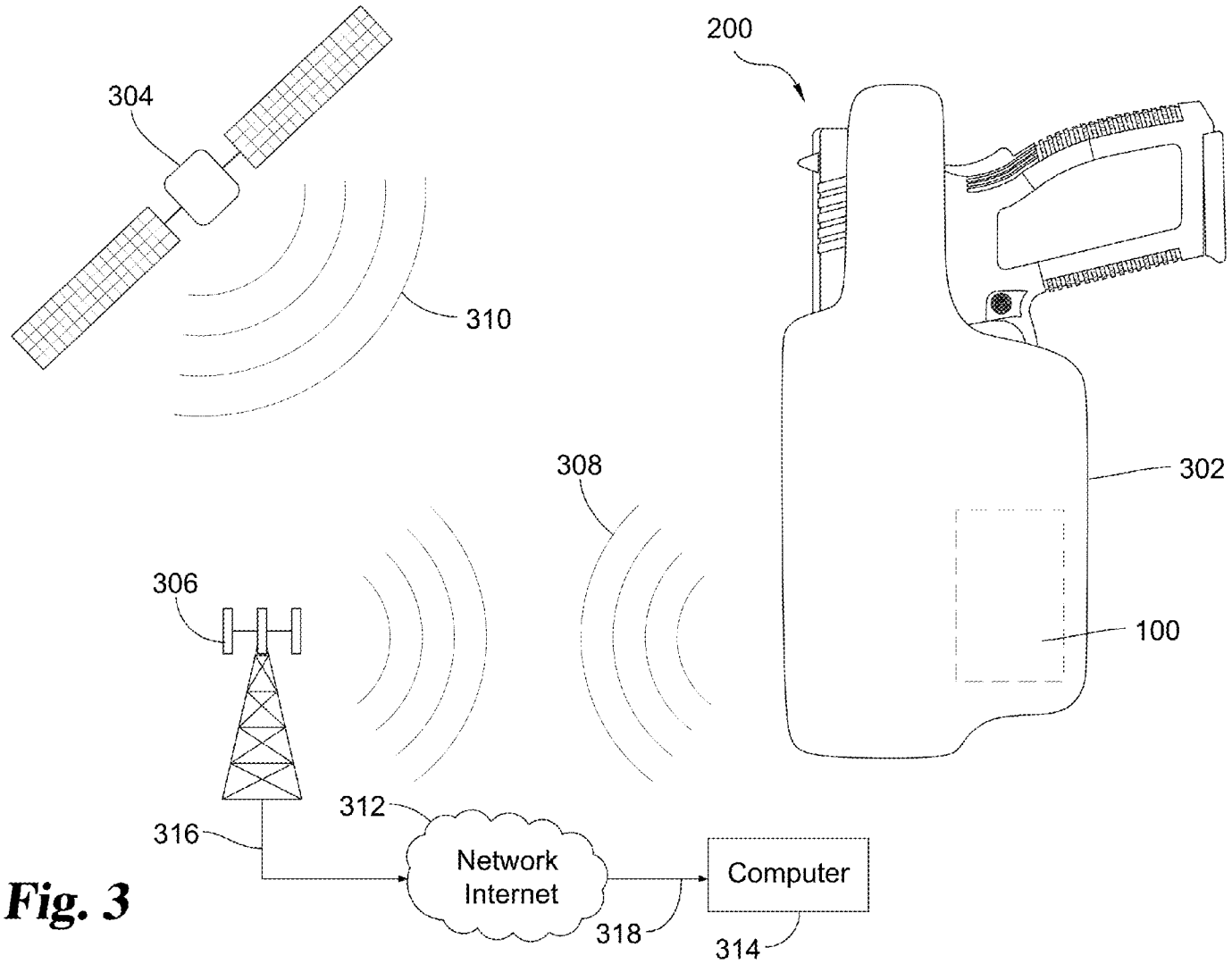
FIG. 3 is a diagram illustrating interaction between the monitoring device of the preceding figures and other remote system components.

FIG. 3-6 illustrate one example of how unit 100 mounted to firearm 200 may be used to record the discharge of firearms and to use the ability to distinguish a discharge of one firearm from another. As shown in FIG. 3, firearm 200 may be carried with a holster 302 by an operator such as a police officer, security guard, soldier, and the like. Unit 100 may be contained within holster 302 as illustrated, or may be outside holster 302 in the case where holster 302 encloses only a portion of firearm 200. Memory 120 may contain mission or duty parameters such as the officer unit 100 is currently assigned to, the assigned patrol area, and the like. This information may be entered into unit 100 when unit 100 is mounted in a maintenance device and before it is coupled to firearm 200.

In a "standby" state as shown in FIG. 3, unit 100 may send and receive various data or location signals. For example, geolocation system 134 may receive location signals 310 using antenna system 136. Location signals 310 may be transmitted by any suitable source, one of which is a satellite 304 which may operate as part of a global navigational system such as GPS. Data signals 308 may also be sent and received by wireless transceiver 128 using antenna system 136. Data signals 308 may be transmitted and received to and from cell tower 306 which may be part of a cellular network. Thus unit 100 may be characterized as a cellular device interacting with a cellular network to send and receive data, communicate with remote computers, and or receive positional information in addition to, or in place of, location signals 310. Data and/or messages may be passed from unit 100 to a remote computer 314 using a network 312 and communications links 316 and 318. These communications links and networks may comprise any combination of wireless or wired networks or links coupled together. One example of such a network is the Internet made available to unit 100 via cellular data communications links. Another example involves operations in remote areas where data signals 308 and other communications from unit 100 may be communicated to a satellite like satellite 304 that is configured with a receiver configured to accept signals 308 and a transmitter for rebroadcasting them to a ground-based antenna and receiver coupled to computer 314 via communications links like links 316 and 318.

Figure 4:
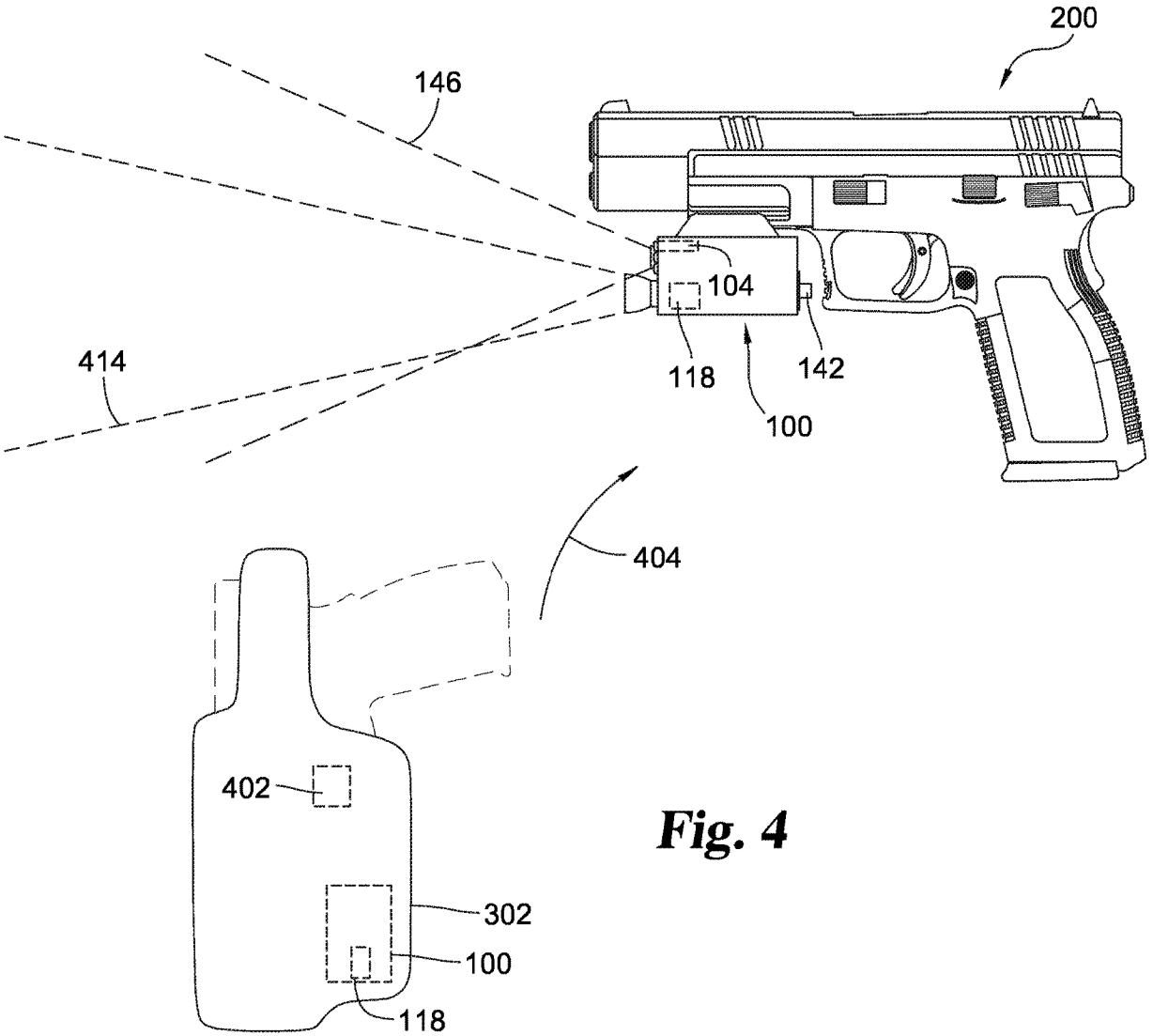
FIG. 4 is a diagram illustrating the monitoring device of the preceding figures activated upon withdrawal from a holster.

FIG. 4 illustrates one example of unit 100 automatically moving from the "standby" state to an "activated" state. In this example, firearm 200 is withdrawn from holster 302 in the direction indicated at 404. As firearm 200 is withdrawn from holster 302, proximity sensor 118 in unit 100 passes within detection range of sensor target 402. A signal from sensor 118 is passed to controller 138 which is configured to activate at least some aspects of unit 100. For example, camera 112 may be activated causing camera 112 to begin recording video or still images to memory 120. Once activated, camera 112 may record at least a portion of what is visible within field of view 146. Controller 138 may also be configured to automatically activate light sources 114 and 108 thus projecting visible or invisible light 414 into at least a portion of field of view 146. In another example, light sources 108 and 114 may be activated (or deactivated) when the operator actuates lamp switch 142 when firearm 200 is drawn. In yet another example, light sources 108 may be automatically activated by controller 138 when firearm 200 is withdrawn, and may remain active substantially continuously until deactivated when firearm arm 200 is inserted into holster 302. Light sources 114 may be activated as desired by the operator manually actuating switch 142. Controller 138 may also automatically begin accepting input signals generated by microphones 104, thus allowing unit 100 to begin recording audio to memory 120 as well as video. These audio and/or video signals may be processed by control logic 124 and processor 122 to detect when a firearm has been discharged.

Figure 5:
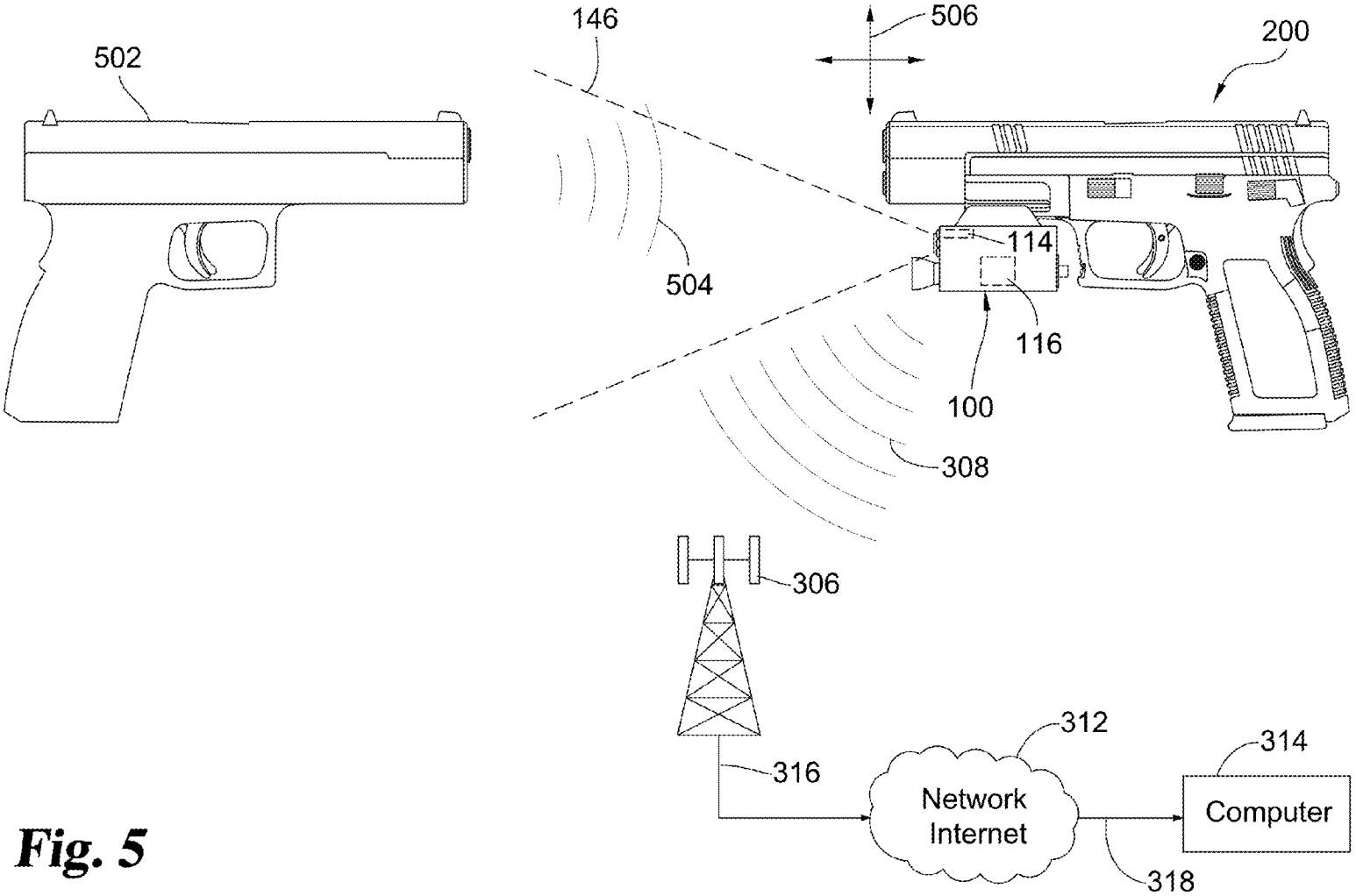
FIG. 5 is a diagram illustrating the detection of a gunshot using the monitoring device of the preceding figures.

Such a discharge is illustrated in FIG. 5 where another firearm 502 is discharged causing sound waves 504 to be detected by microphones 104. In this example, video record of the discharge may also captured as firearm 502 is within the field of view 406 of camera 112. In other instances, microphones 104 may also detect other firearms that may be outside the field-of-view 146. Sound waves received by microphones 104 may be converted to electrical signals and processed by controller 138 which may use or include processor 122. Control logic 124 may compare a digital or analog signal received from microphones 104 to one or more acoustic signatures, and may determine from the signal that a gunshot has just occurred. Control logic 124 may measure changes in frequency and amplitude of the signal, and may thus distinguish the sound of a gunshot from other sounds that may be similar in some respects such as a vehicle backfiring or fireworks exploding.

Controller 138 may use processor 122 to create a message that includes data about the discharge of firearm 502. Such data may include the date and time the gunshot was detected, and the location of unit 100 based on the last known location as given by geolocation system 134. The direction unit 100 was pointed in may be included, as well as one or more of the duty parameters about the officer or other operator such as name, badge number, rank, assigned patrol area, and the like.

In another example, firearm 200 may discharge before or after, or instead of, firearm 502. This discharge may be detected by movement of firearm 200 in one or more directions illustrated at 506 (i.e. due to recoil, muzzle lift, or other movements). Changes in acceleration, velocity, or position of firearm 200 resulting from movement of the firearm may be detected by motion sensor 116 and converted to electrical signals processed by controller 138. Using processor 122, controller 138 may compare the signals with control logic 124. The time-varying digital or analog signal received from motion sensor 116 may be processed as discussed herein to determine that firearm 200 has been discharged. Control logic 124 may measure changes in the velocity and position, thus distinguishing movement related to a gun discharge from other types of movement firearm 200 may experience such as movement that occurs when the operator runs or jumps with the weapon drawn, or drops the weapon.

In yet another example, unit 100 may be configured to determine that firearm 502 was discharged at one point in time based on sound waves detected by microphones 104 as discussed above, and determine that firearm 200 was discharged at some other point in time based on the movement of firearm 200 detected by motion sensor 116. Control logic 124 may be configured to distinguish one gunshot from another thus allowing the unit to send additional information indicating which firearm was discharged—firearm 200 (e.g. a police officer's firearm) or firearm 502 (e.g. a firearm fired at the police officer by an armed assailant). Thus weapon mounted unit 100 may be configured to detect the discharge of multiple weapons, and to determine when the discharge is from the weapon unit 100 is mounted too, and the weapon discharged is some other weapon in the area of unit 100.

All information collected by unit 100 may be included in a message, or in multiple messages sent to a remote computer. For example, controller 138 may use processor 122 to create a message that includes distinguishing information indicating whether the gunshot being reported is from weapon 502, weapon 200, or from some other weapon. This data may include the date and time the gunshot was detected, and the location of unit 100 based on the last known location as given by geolocation system 134. Any other data may be transmitted as well such as one or more of the duty parameters about the officer or other operator such as name, badge number, rank, supervisor, assigned patrol area, and the like.

Controller 138 may use processor 122 to create a message that includes data about the discharge of firearm 200. Such data may include the date and time the gunshot was detected, and the location of unit 100 based on the last known location as given by geolocation system 134 or another such location-finding system. The direction unit 100 was pointed in may be included, as well as one or more of the duty parameters about the officer or other operator such as name, badge number, rank, assigned patrol area, and the like.

Any messages transmitted from unit 100 may be sent using wireless transceiver 128 and antenna system 138 under the control of controller 138. Wireless transceiver 128 may transmit the messages to a receiver such as cellular receiver in cell tower 306. Network 312 can carry the message and the data it contains to computer 314 for storage or further processing.

Information about gunshots detected by weapon unit 100 may be received by computer 314 and processed in any suitable fashion. In one example, computer 314 may store the information in an archive, and/or cause the data from the message to be displayed on a user interface like the one shown in FIG. 6 at 600. A map display 602 may display a map of the general area. The area displayed can depend on the patrol area involved. In the case of a police department, the area displayed may include one or more city blocks, a small town, or a county to name a few examples. In another example, the display area may include a military base, a mall, a sports venue, and the like. Any suitable display area may be used at 602.

Computer 314 may be configured to display alert or warning indicia 604 indicating shots have been fired. Such indicia may be colored (e.g. red) and/or animated (e.g. flashing) to attract the attention of a person monitoring the display. Location indicia 606 such as a dot, square, image of a pin, and the like, may be displayed on the user interface over the area of the map image that corresponds with the actual location the discharge was detected. Other indicia may be included such as lines, arrows, colors, and the like indicating whether the discharge came from the firearm unit 100 is attached to, or whether it came from another firearm.

The approximate address of the location may be determined by calculated by computer 314 based on information sent by monitoring unit 100 and displayed on map display 602 at location 608. Other additional information about the person operating firearm 200 may be displayed at 610. This information may include the operator's name, badge number, and any information relevant to the incident.

Figure 7:
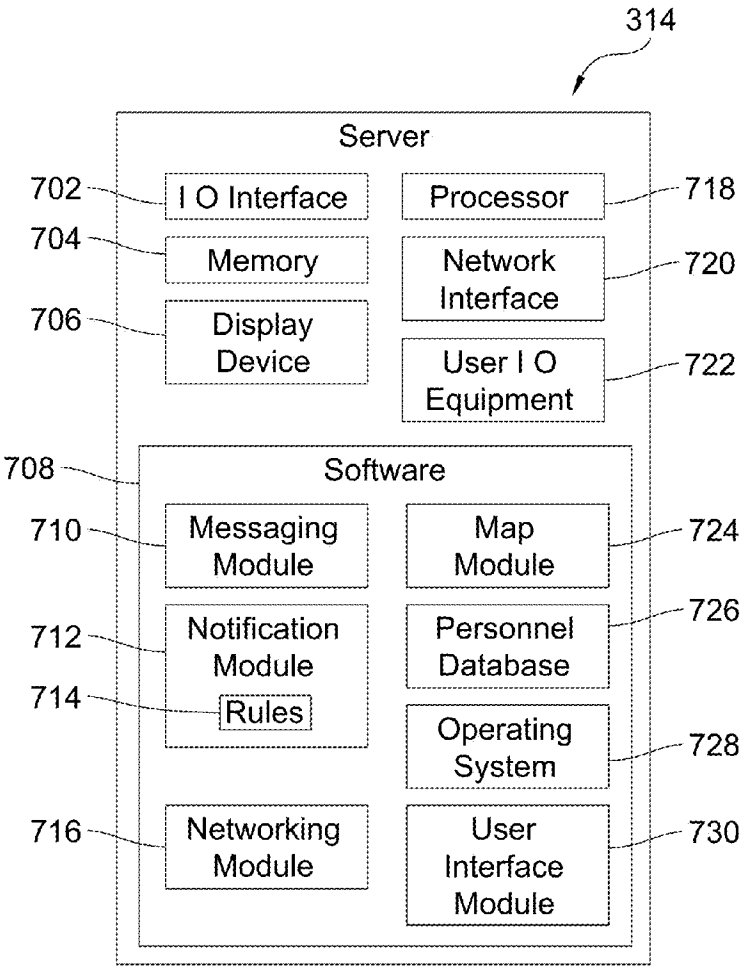
FIG. 7 is a component diagram illustrating aspects of a computer in communication with the monitoring apparatus of preceding figures.
Figure 6:
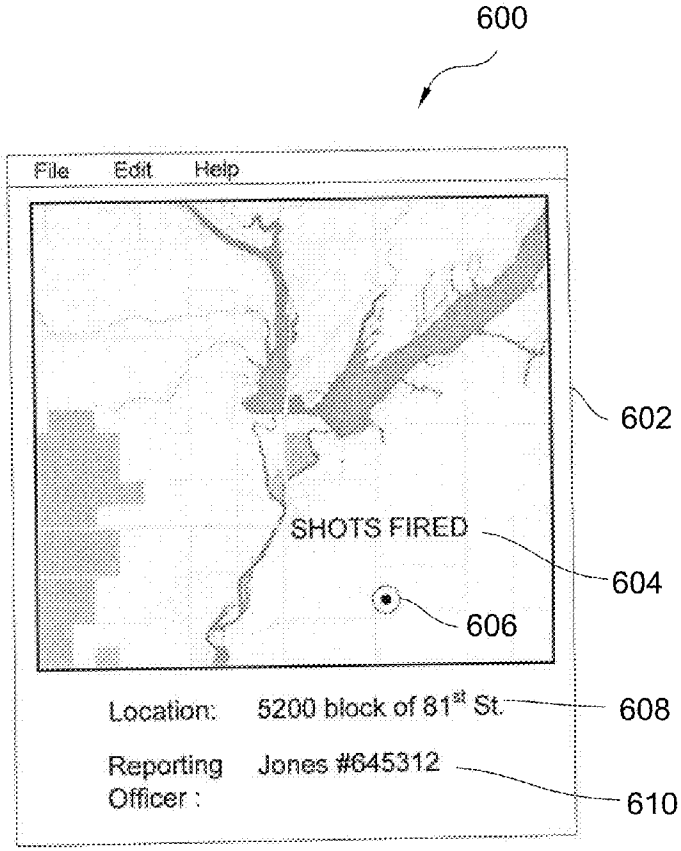
FIG. 6 is a diagram illustrating a user interface generated by a computer in communication with the monitoring apparatus of preceding figures.

Additional details about remote computer 314 are illustrated in FIG. 7. Computer 314 may be any suitable computing device such as a server, desktop computer, or other personal computing device, and may include various hardware and software components useful for implementing the collection and dissemination of weapons discharge information.

As illustrated in FIG. 7, computer 314 may include a processor 718 for executing instructions encoded in software 708. A network interface 720 may be configured to interact with networks like network 312 in FIG. 5 via communications links like links 316 and 318. Computer 314 may also include user I/O equipment 340 such as keyboards, mice, or other I/O devices. A display device 706 may be included as well for displaying a user interface such as user interface 600 generated by computer 314. A memory 704 may be included as well for temporarily or permanently storing data values or instructions and the like.

Software 708 may include various modules such an operating system 728 for configuring basic operation of computer 314. Operating system 728 may also provide a standard set of Application Programmer Interfaces (APIs) for handling basic programming and system configuration functions of computer 314.

Software 708 may include a database 726 which may be used to store information used by the system such as contact information for various individuals who may be using firearms equipped with a unit like unit 100. Contact information in database 726 may include names, addresses, email addresses, and telephone numbers as well as other information such as duty rosters, assigned patrol areas, or information about equipment available for use, or any other suitable information useful for distinguishing, reporting and/or responding to the discharge of a firearm. Contact information in database 726 may include URLs, web service information, operating parameters, aliases, passwords, encryption keys, and other information useful for establishing and maintaining communications links between computer 314 and other computers or devices such as other personal computing devices, or monitoring units like units 100.

A user interface module 730 may also be provided for generating user interfaces like user interface 600 which may include graphical buttons, windows, text boxes, selection boxes, and other widgets which may be accessible using any suitable input device such as a touch screen, mouse, or keyboard. User interface module 730 may also display various glyphs, figures, icons, graphs, charts, tabular displays, and the like which may or may not be modified or interacted with using any suitable input device. User interface module 730 may be used in conjunction with other software modules to provide navigational control between various presentations of information, to accept character or selection input from an input device, and/or to generate graphical displays of relevant data accessed by other software modules. User interface module 730 may operate in conjunction with operating system 728 which may include libraries of windowing widgets, basic input/output capabilities, and basic file system and network interfaces for user interface module 730 and for other software modules as well.

User interface module 730 may use any suitable technology, programming language, toolkit, API, and/or protocol to create user interfaces. Module 730 may, for example, generate dynamically created web pages using Hypertext Markup Language (HTML) or other similar markup languages which can be sent to client computing devices via network 312 for viewing in a web browser, or for viewing using customized client apps or applications. Computer 314 may also implement various web services responding to messages or requests for information made by client computers seeking information about events, monitored equipment or devices, contacts, notification configuration parameters, or any other information made available by computer 314.

A messaging module 710 may be included with software for configuring computer 314 to process incoming messages from one or more reporting units like unit 100. Messaging module 710 may also be configured to send messages of different types. Such messages may include machine-to-machine messages such as an XML message, email messages, and/or Short Message Service (SMS) messages.

A notification module 712 may be included with software for configuring computer 314 to process incoming notifications, such as notifications that may have been initially received by messaging module 710. Messaging module 710 may then formulate outgoing notification messages to other machines. One example is a notification message distributed to entities or systems whose contact information is in database 726. This may include individuals who are using an application on a personal computing device that is configured to receive these notifications, or other computers or systems configured to receive information from computer 314.

For example, computer 314 may be a central server for receiving messages from units like unit 100, processing them using messaging module 710, and then distributing notifications to members of a first alert or on-call team, computers operating in a local or regional command center configured to display a user interface like user interface 600, and/or one or more individual high-ranking personnel using a personal computing device who are tasked with staying abreast of rapidly unfolding situations that may involve the discharge of a firearm. Notifications may be distributed by notification module 712, by messaging module 710, or both separately or in collaboration. Notifications may take the form of e-mails, SMS messages, push notifications, or any other suitable notification system. For example, notification module 712 may configure computer 314 to interact with centralized push notification servers using network interface 720, and/or any suitable communications links like communications link 318.

Notification module 712 may include one or more rules 714 useful for determining what contacts to notify with specific notification information and under what circumstances to do so. Notification module 712 may also access database 726 when a rule 714 is triggered indicating a specific contact who is to receive specific information for a given reported event. Rules 714 may use messaging module 710, networking module 716 and/or any other software module or hardware to distribute notification information according to rules 714.

For example, when a weapon mounted monitoring unit like unit 100 reports the discharge of one or more firearms at a given location and time, rules 714 may specify that a command center is to be notified by sending a formatted data message to a computer at the command center; that a ranking officer such as a shift sergeant or captain (in the case of a military force or civilian police department) is to be notified via an SMS message to the officer's personal computing device (e.g. a smart phone); and that any other assets or officers currently in the same patrol area should be sent a formatted computer-to-computer data message to their in-car computers and/or personal devices. In-car computers may then alert the officers or other assets to respond. Any one of the computers in this example may be configured to display a user interface like interface 600, along with any other relevant information.

In another example, rules 714 may include rules comparing the date/time information and location information of each reported discharge incident, and may respond differently depending on the time between discharges, the distance between locations, and/or any other differences or changes in relevant information. For example, if the time between registered discharges is less than a predetermined target or threshold, and the locations between discharges is less than a second predetermined target, additional assets may be automatically alerted with the relevant information. In this example, the system may automatically begin escalating a response as additional information becomes available such as additional shots being fired at a given location. Similarly, rules 714 may respond differently if the distance and/or time between shots fired is greater than a predetermined threshold. Officers or other assets may not be notified, or may be notified in a "stand by" capacity indicating they need not immediately respond, but may be called on if additional shots are detected in the near future.

Networking module 716 may include software for configuring computer 314 to establish and maintain network communications with other devices, such as via communication link 318. Networking module 716 may therefore configure processor 718, network interface 720, I/O interface 702, and any other suitable hardware or software in computer 314 to create and maintain communications with other computers. Various protocols such as, Transmission Control Protocol/Internet Protocol (TCP/IP), User Datagram Protocol (UDP), Ethernet protocol, or any other suitable networking protocol may be implemented in networking module 716. Any of these protocols may be used to establish network communications which may then be used to interact with a weapon mounted monitoring units like unit 100, with personal computing devices, or with any other computers they system may interact with.

Figure 8:
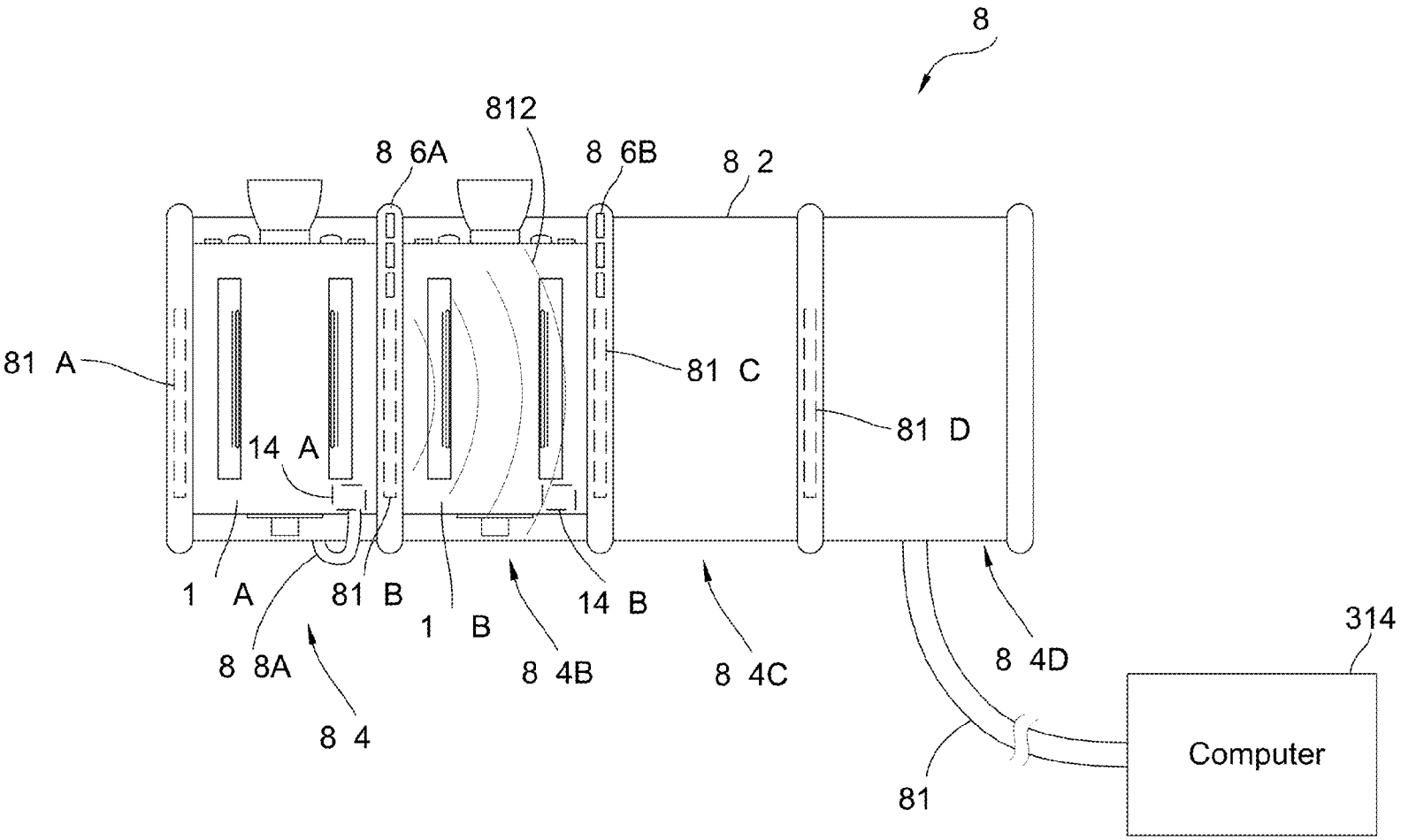
FIG. 8 is a diagram illustrating a maintenance device for use with the monitoring apparatus of preceding figures.

Illustrated in FIG. 8 is an example of a maintenance device at 800 for recharging, downloading data from, and/or store one or more monitoring units 100. As illustrated, maintenance device 802 includes multiple maintenance bays or mounts 804A-804D. Bays 804 are configured in the illustrated example to each accept a monitoring unit 100. Any suitable configuration useful for coupling or pairing units 100 to a maintenance device is envisioned. For example, a portion of the maintenance device may be inserted into and accepted by the monitoring unit such as a rail portion of the maintenance unit inserted between arms 106A and B.

The monitoring unit may be coupled to the maintenance device, such as by an electrical communications link 808A operatively coupled to port 140A. In another example, maintenance device 802 includes antenna arrays 810A-810D which can transmit and receive electromagnetic energy between arrays 810 and a corresponding antenna array in port 140B. This configuration allows maintenance device 802 to establish and maintain a wireless communications link 812 between maintenance device 802 and units 100. Power may be sent to units 100 for charging battery 126, and for upload and download data to and from memory 120, using links 808 and 812. Status indicators 806A-806D may be included with each corresponding bay 804 to indicate the state of an individual unit 100 such as charging status and battery state of charge, whether data is or is not currently being uploaded or downloaded with maintenance device 802, and the like.

In operation, unit 100A may be removed from maintenance device 802, and coupled to a firearm like firearm 200. The unit may be initialized with data about the person who will be carrying firearm 200, the patrol area, and the like using computer 314. An operator using computer 314 may initialize units 100A and 100B with this information at any suitable time, such as before each shift as officers are preparing for a patrol. Unit 100A may then be used as discussed above to differentiate, record, and report gunshots as discussed herein elsewhere. Memory 120 in unit 100A may include one or more images or videos captured during the course of a shift providing, for example, a video record of events taking place down-range of firearm 200 starting at a first time when firearm 200 was removed from holster 302 and activated, to a second later time when firearm 200 was re-holstered.

Upon returning unit 100A to maintenance device 802, such as at the end of a shift, or after a particular event, unit 100A may be decoupled from firearm 200 and returned to maintenance bay 804A (or any other bay 804 that is not in use). Some or all of any audio, video, location information, and the like may be copied or removed from memory 120 in units 100 and transferred to computer 314 via wired or wireless communications link 810. Memory 120 may be maintained within unit 100 and may not require physical removal such as in the case of a removable memory card. Where the memory 120 is maintained within units 100 without the option to physically remove it, the record of events may be maintained while reducing or eliminating the risk of tampering with, destroying, editing, or otherwise compromising recordings of the sounds, images, etc. captured by monitoring unit 100A.

Glossary of Definitions and Alternatives

While the invention is illustrated in the drawings and described herein, this disclosure is to be considered as illustrative and not restrictive in character. The present disclosure is exemplary in nature and all changes, equivalents, and modifications that come within the spirit of the invention are included. The detailed description is included herein to discuss aspects of the examples illustrated in the drawings for the purpose of promoting an understanding of the principles of the invention. No limitation of the scope of the invention is thereby intended. Any alterations and further modifications in the described examples, and any further applications of the principles described herein are contemplated as would normally occur to one skilled in the art to which the invention relates. Some examples are disclosed in detail, however some features that may not be relevant may have been left out for the sake of clarity.

Where there are references to publications, patents, and patent applications cited herein, they are understood to be incorporated by reference as if each individual publication, patent, or patent application were specifically and individually indicated to be incorporated by reference and set forth in its entirety herein.

Singular forms "a", "an", "the", and the like include plural referents unless expressly discussed otherwise. As an illustration, references to "a device" or "the device" include one or more of such devices and equivalents thereof.

Directional terms, such as "up", "down", "top" "bottom", "fore", "aft", "lateral", "longitudinal", "radial", "circumferential", etc., are used herein solely for the convenience of the reader in order to aid in the reader's understanding of the illustrated examples. The use of these directional terms does not in any manner limit the described, illustrated, and/or claimed features to a specific direction and/or orientation.

Multiple related items illustrated in the drawings with the same part number which are differentiated by a letter for separate individual instances, may be referred to generally by a distinguishable portion of the full name, and/or by the number alone. For example, if multiple "laterally extending elements" 90A, 90B, 90C, and 90D are illustrated in the drawings, the disclosure may refer to these as "laterally extending elements 90A-90D," or as "laterally extending elements 90," or by a distinguishable portion of the full name such as "elements 90".

The language used in the disclosure are presumed to have only their plain and ordinary meaning, except as explicitly defined below. The words used in the definitions included herein are to only have their plain and ordinary meaning. Such plain and ordinary meaning is inclusive of all consistent dictionary definitions from the most recently published Webster's and Random House dictionaries. As used herein, the following definitions apply to the following terms or to common variations thereof (e.g., singular/plural forms, past/present tenses, etc.):

"Antenna" or "Antenna system" generally refers to an electrical device, or series of devices, in any suitable configuration, that converts electric power into electromagnetic radiation. Such radiation may be either vertically, horizontally, or circularly polarized at any frequency along the electromagnetic spectrum. Antennas transmitting with circular polarity may have either right-handed or left-handed polarization.

In the case of radio waves, an antenna may transmit at frequencies ranging along electromagnetic spectrum from extremely low frequency (ELF) to extremely high frequency (EHF). An antenna or antenna system designed to transmit radio waves may comprise an arrangement of metallic conductors (elements), electrically connected (often through a transmission line) to a receiver or transmitter. An oscillating current of electrons forced through the antenna by a transmitter can create an oscillating magnetic field around the antenna elements, while the charge of the electrons also creates an oscillating electric field along the elements. These time-varying fields radiate away from the antenna into space as a moving transverse electromagnetic field wave. Conversely, during reception, the oscillating electric and magnetic fields of an incoming electromagnetic wave exert force on the electrons in the antenna elements, causing them to move back and forth, creating oscillating currents in the antenna. These currents can then be detected by receivers and processed to retrieve digital or analog signals or data.

Antennas can be designed to transmit and receive radio waves substantially equally in all horizontal directions (omnidirectional antennas), or preferentially in a particular direction (directional or high gain antennas). In the latter case, an antenna may also include additional elements or surfaces which may or may not have any physical electrical connection to the transmitter or receiver. For example, parasitic elements, parabolic reflectors or horns, and other such non-energized elements serve to direct the radio waves into a beam or other desired radiation pattern. Thus antennas may be configured to exhibit increased or decreased directionality or "gain" by the placement of these various surfaces or elements. High gain antennas can be configured to direct a substantially large portion of the radiated electromagnetic energy in a given direction that may be vertical horizontal or any combination thereof.

Antennas may also be configured to radiate electromagnetic energy within a specific range of vertical angles (i.e. "takeoff angles) relative to the earth in order to focus electromagnetic energy toward an upper layer of the atmosphere such as the ionosphere. By directing electromagnetic energy toward the upper atmosphere at a specific angle, specific skip distances may be achieved at particular times of day by transmitting electromagnetic energy at particular frequencies.

Other examples of antennas include emitters and sensors that convert electrical energy into pulses of electromagnetic energy in the visible or invisible light portion of the electromagnetic spectrum. Examples include light emitting diodes, lasers, and the like that are configured to generate electromagnetic energy at frequencies ranging along the electromagnetic spectrum from far infrared to extreme ultraviolet.

"Battery" generally refers to an electrical energy storage device or storage system including multiple energy storage devices. A battery may include one or more separate electrochemical cells, each converting stored chemical energy into electrical energy by a chemical reaction to generate an electromotive force (or "EMF" measured in Volts). An individual battery cell may have a positive terminal (cathode) with a higher electrical potential, and a negative terminal (anode) that is at a lower electrical potential than the cathode. Any suitable electrochemical cell may be used that employ any suitable chemical process, including galvanic cells, electrolytic cells, fuel cells, flow cells and voltaic piles. When a battery is connected to an external circuit, electrolytes are able to move as ions within the battery, allowing the chemical reactions to be completed at the separate terminals thus delivering energy to the external circuit.

A battery may be a "primary" battery that can produce current immediately upon assembly. Examples of this type include alkaline batteries, nickel oxyhydroxide, lithium-copper, lithium-manganese, lithium-iron, lithium-carbon, lithium-thionyl chloride, mercury oxide, magnesium, zinc-air, zinc-chloride, or zinc-carbon batteries. Such batteries are often referred to as "disposable" insofar as they are generally not rechargeable and are discarded or recycled after discharge.

A battery may also be a "secondary" or "rechargeable" battery that can produce little or no current until charged. Examples of this type include lead-acid batteries, valve regulated lead-acid batteries, sealed gel-cell batteries, and various "dry cell" batteries such as nickel-cadmium (NiCd), nickel-zinc (NiZn), nickel metal hydride (NiMH), and lithium-ion (Li-ion) batteries.

"Camera" generally refers to an apparatus or assembly that records images of a viewing area or field-of-view on a medium or in a memory. The images may be still images comprising a single frame or snapshot of the viewing area, or a series of frames recorded over a period of time that may be displayed in sequence to create the appearance of a moving image. Any suitable media may be used to store, reproduce, record, or otherwise maintain the images.

"Cellular Device" generally refers to a device which sends or receives data, and/or sends or receives telephone calls using a cellular network. Cellular devices may thus be characterized as nodes in a communications link operating as an originating and/or final receiving node. A cellular device transmits to and receives from a cellular transceiver located in the cell (e.g. at a base unit or "cell tower.") Radio waves are generally used to transfer signals to and from the cellular device on a frequency that is specific (but not necessarily unique) to each cell. A cellular device may include a computer with memory, processor, display device, input/output devices, and so forth, and thus may be used as, and referred to as, a personal computing device.

"Cellular Network" or "mobile network" generally refers to a communications link or communications network where the final communications link to an originating sending node or final receiving node in the network is via a wireless link. The cellular network is distributed over land areas ("cells"), each cell served by at least one fixed-location transceiver known as a cell site, base station, or generically, a "cell tower". This base station provides the cell with the network coverage which can be used for transmission of voice, data and other types of communication. In a cellular network, each cell uses a different set of frequencies from neighboring cells, to avoid interference and provide guaranteed bandwidth within each cell.

In a cellular network, switching from one cell frequency to a different cell frequency is done electronically without interruption as various mobile devices with transceivers configured to communicate with the network (i.e. the originating or final receiver nodes) move from cell to cell during an ongoing continuous communication, all generally without a base station operator or manual switching. This is called the "handover" or "handoff." Typically, a new channel is automatically selected for the mobile device on the new base station which will serve it as the mobile device moves around in the cell. The mobile unit then automatically switches from the current channel to the new channel and communication continues. The most common example of a cellular network is a mobile phone (cell phone) network.

"Communication Link" generally refers to a connection between two or more communicating entities and may or may not include a communications channel between the communicating entities. The communication between the communicating entities may occur by any suitable means. For example the connection may be implemented as an actual physical link, an electrical link, an electromagnetic link, a logical link, or any other suitable linkage facilitating communication.

In the case of an actual physical link, communication may occur by multiple components in the communication link configured to respond to one another by physical movement of one element in relation to another. In the case of an electrical link, the communication link may be composed of multiple electrical conductors electrically connected to form the communication link.

In the case of an electromagnetic link, the connection may be implemented by sending or receiving electromagnetic energy at any suitable frequency, thus allowing communications to pass as electromagnetic waves. These electromagnetic waves may or may not pass through a physical medium such as an optical fiber, or through free space, or any combination thereof. Electromagnetic waves may be passed at any suitable frequency including any frequency in the electromagnetic spectrum.

In the case of a logical link, the communication link may be a conceptual linkage between the sender and recipient such as a transmission station in the receiving station. Logical link may include any combination of physical, electrical, electromagnetic, or other types of communication links.

"Communication node" generally refers to a physical or logical connection point, redistribution point or endpoint along a communication link. A physical network node is generally referred to as an active electronic device attached or coupled to a communication link, either physically, logically, or electromagnetically. A physical node is capable of sending, receiving, or forwarding information over a communication link. A communication node may or may not include a computer, processor, transmitter, receiver, repeater, and/or transmission lines, or any combination thereof.

"Computer" generally refers to any computing device configured to compute a result from any number of input values or variables. A computer may include a processor for performing calculations to process input or output. A computer may include a memory for storing values to be processed by the processor, or for storing the results of previous processing.

A computer may also be configured to accept input and output from a wide array of input and output devices for receiving or sending values. Such devices include other computers, keyboards, mice, visual displays, printers, industrial equipment, and systems or machinery of all types and sizes. For example, a computer can control a network or network interface to perform various network communications upon request. The network interface may be part of the computer, or characterized as separate and remote from the computer.

A computer may be a single, physical, computing device such as a desktop computer, a laptop computer, or may be composed of multiple devices of the same type such as a group of servers operating as one device in a networked cluster, or a heterogeneous combination of different computing devices operating as one computer and linked together by a communication network. The communication network connected to the computer may also be connected to a wider network such as the internet. Thus a computer may include one or more physical processors or other computing devices or circuitry, and may also include any suitable type of memory.

A computer may also be a virtual computing platform having an unknown or fluctuating number of physical processors and memories or memory devices. A computer may thus be physically located in one geographical location or physically spread across several widely scattered locations with multiple processors linked together by a communication network to operate as a single computer.

The concept of "computer" and "processor" within a computer or computing device also encompasses any such processor or computing device serving to make calculations or comparisons as part of the disclosed system. Processing operations related to threshold comparisons, rules comparisons, calculations, and the like occurring in a computer may occur, for example, on separate servers, the same server with separate processors, or on a virtual computing environment having an unknown number of physical processors as described above.

A computer may be optionally coupled to one or more visual displays and/or may include an integrated visual display. Likewise, displays may be of the same type, or a heterogeneous combination of different visual devices. A computer may also include one or more operator input devices such as a keyboard, mouse, touch screen, laser or infrared pointing device, or gyroscopic pointing device to name just a few representative examples. Also, besides a display, one or more other output devices may be included such as a printer, plotter, industrial manufacturing machine, 3D printer, and the like. As such, various display, input and output device arrangements are possible.

Multiple computers or computing devices may be configured to communicate with one another or with other devices over wired or wireless communication links to form a network. Network communications may pass through various computers operating as network appliances such as switches, routers, firewalls or other network devices or interfaces before passing over other larger computer networks such as the internet. Communications can also be passed over the network as wireless data transmissions carried over electromagnetic waves through transmission lines or free space. Such communications include using WiFi or other Wireless Local Area Network (WLAN) or a cellular transmitter/receiver to transfer data.

"Data" generally refers to one or more values of qualitative or quantitative variables that are usually the result of measurements. Data may be considered "atomic" as being finite individual units of specific information. Data can also be thought of as a value or set of values that includes a frame of reference indicating some meaning associated with the values. For example, the number "2" alone is a symbol that absent some context is meaningless. The number "2" may be considered "data" when it is understood to indicate, for example, the number of items produced in an hour.

Data may be organized and represented in a structured format. Examples include a tabular representation using rows and columns, a tree representation with a set of nodes considered to have a parent-children relationship, or a graph representation as a set of connected nodes to name a few.

The term "data" can refer to unprocessed data or "raw data" such as a collection of numbers, characters, or other symbols representing individual facts or opinions. Data may be collected by sensors in controlled or uncontrolled environments, or generated by observation, recording, or by processing of other data. The word "data" may be used in a plural or singular form. The older plural form "datum" may be used as well.

"Database" also referred to as a "data store", "data repository", or "knowledge base" generally refers to an organized collection of data. The data is typically organized to model aspects of the real world in a way that supports processes obtaining information about the world from the data. Access to the data is generally provided by a "Database Management System" (DBMS) consisting of an individual computer software program or organized set of software programs that allow user to interact with one or more databases providing access to data stored in the database (although user access restrictions may be put in place to limit access to some portion of the data). The DBMS provides various functions that allow entry, storage and retrieval of large quantities of information as well as ways to manage how that information is organized. A database is not generally portable across different DBMSs, but different DBMSs can interoperate by using standardized protocols and languages such as Structured Query Language (SQL), Open Database Connectivity (ODBC), Java Database Connectivity (JDBC), or Extensible Markup Language (XML) to allow a single application to work with more than one DBMS.

Databases and their corresponding database management systems are often classified according to a particular database model they support. Examples include a DBMS that relies on the "relational model" for storing data, usually referred to as Relational Database Management Systems (RDBMS). Such systems commonly use some variation of SQL to perform functions which include querying, formatting, administering, and updating an RDBMS. Other examples of database models include the "object" model, the "object-relational" model, the "file", "indexed file" or "flat-file" models, the "hierarchical" model, the "network" model, the "document" model, the "XML" model using some variation of XML, the "entity-attribute-value" model, and others.

Examples of commercially available database management systems include PostgreSQL provided by the PostgreSQL Global Development Group; Microsoft SQL Server provided by the Microsoft Corporation of Redmond, Wash., USA; MySQL and various versions of the Oracle DBMS, often referred to as simply "Oracle" both separately offered by the Oracle Corporation of Redwood City, Calif., USA; the DBMS generally referred to as "SAP" provided by SAP SE of Walldorf, Germany; and the DB2 DBMS provided by the International Business Machines Corporation (IBM) of Armonk, N.Y., USA.

The database and the DBMS software may also be referred to collectively as a "database". Similarly, the term "database" may also collectively refer to the database, the corresponding DBMS software, and a physical computer or collection of computers. Thus the term "database" may refer to the data, software for managing the data, and/or a physical computer that includes some or all of the data and/or the software for managing the data.

"Display device" generally refers to a device capable of being controlled by an electronic circuit or processor to display information in a visual or tactile. A display device may be configured as an input device taking input from a user or other system (e.g. a touch sensitive computer screen), or as an output device generating visual or tactile information, or the display device may configured to operate as both an input or output device at the same time, or at different times.

The output may be two-dimensional, three-dimensional, and/or mechanical displays and includes, but is not limited to, the following display technologies: Cathode ray tube display (CRT), Light-emitting diode display (LED), Electroluminescent display (ELD), Electronic paper, Electrophoretic Ink (E-ink), Plasma display panel (PDP), Liquid crystal display (LCD), High-Performance Addressing display (HPA), Thin-film transistor display (TFT), Organic light-emitting diode display (OLED), Surface-conduction electron-emitter display (SED), Laser TV, Carbon nanotubes, Quantum dot display, Interferometric modulator display (IMOD), Swept-volume display, Varifocal mirror display, Emissive volume display, Laser display, Holographic display, Light field displays, Volumetric display, Ticker tape, Split-flap display, Flip-disc display (or flip-dot display), Rollsign, mechanical gauges with moving needles and accompanying indicia, Tactile electronic displays (aka refreshable Braille display), Optacon displays, or any devices that either alone or in combination are configured to provide visual feedback on the status of a system, such as the "check engine" light, a "low altitude" warning light, an array of red, yellow, and green indicators configured to indicate a temperature range.

"Firearm" or "Gun" generally refers to a device that launches, discharges, or otherwise propels one or more projectiles, typically at a high rate of speed. Projectiles may be referred to as "bullets", "rounds", "shot", "shells", and the like, and may be propelled by any suitable means such as by the force of an expanding gas, by electromagnetic energy, or by rapidly releasing energy stored in a biasing element such as a spring or elastic band. Expanding gas may be created or expelled by an explosion behind the projectile, or by rapid expansion of a gas stored under high pressure such as Carbon Dioxide ($CO_2$). Firearms may launch projectiles at speeds of less than 100 feet per second to speeds that are greater than 4000 feet per second.

Types of firearms include smaller guns such as pistols or handguns, larger firearms such as rifles, shotguns, automatic rifles, and the like, and can include larger weapons as well. As used herein, "firearm" include revolvers (also known as "wheel guns") and automatic or semi-automatic guns configured with magazines carrying multiple rounds and capable of firing one or more rounds with a single activation of the triggering mechanism. Also included are guns which must be reloaded after each discharge such as muzzle-loading single shot rifle or a single barrel breach-loading shot gun.

"Holster" generally refers to a device or assembly configured to hold a firearm. A holster may be configured to receive a portion of the firearm such as the barrel portion, much like a sheath or scabbard can for a knife or sword respectively.

A holster may be constructed of any suitable combination of materials such as carbon fiber, metal, plastic or other polymeric material, leather, or cloth. A holster may be worn by a person for easy access and/or concealment. Any suitable location may be useful such as on a person's belt at the waist, on a utility or cargo harness on the front or sides of the chest, or on the thigh or ankle of a person's leg to name a few non-limiting examples. A holster may mounted in any other suitable location where a firearm may be held in place such as attached to a vehicle, on a saddle used for riding horses, in an enclosure such as a safe, lockbox, or cabinet.

"Input Device" generally refers to a device coupled to a computer that is configured to receive input and deliver the input to a processor, memory, or other part of the computer. Such input devices can include keyboards, mice, trackballs, touch sensitive pointing devices such as touchpads, or touchscreens. Input devices also include any sensor or sensor array for detecting environmental conditions such as temperature, light, noise, vibration, humidity, and the like.

"Lamp", "Light Source", or "Light Emitter" generally refers to a device configured to emit light when energized by electrical energy. Examples include light bulbs such as incandescent, fluorescent, mercury-vapor, halogen, metal-halide, plasma and xenon flash lamps to name a few non-limiting examples. Other examples include semiconductors such as Light Emitting Diodes (LEDs). Lamps may produce light that may or may not be visible to the naked eye. For example, an LED may emit light that is in the Infra-red range of the electromagnetic spectrum and may be used to illuminate an area with light received by corresponding infra-red sensors or cameras making it possible to view objects through the camera in total darkness.

"Memory" generally refers to a storage system or device configured to retain data or information. Each memory may include one or more types of solid-state electronic memory, magnetic memory, or optical memory, just to name a few. Memory may use any suitable storage technology, or combination of storage technologies, and may be volatile, non-volatile, or a hybrid combination of volatile and nonvolatile varieties. By way of non-limiting example, each memory may include solid-state electronic Random Access Memory (RAM), Sequentially Accessible Memory (SAM) (such as the First-In, First-Out (FIFO) variety or the Last-In-First-Out (LIFO) variety), Programmable Read Only Memory (PROM), Electronically Programmable Read Only Memory (EPROM), or Electrically Erasable Programmable Read Only Memory (EEPROM).

Memory can refer to Dynamic Random Access Memory (DRAM) or any variants, including static random access memory (SRAM), Burst SRAM or Synch Burst SRAM (BSRAM), Fast Page Mode DRAM (FPM DRAM), Enhanced DRAM (EDRAM), Extended Data Output RAM (EDO RAM), Extended Data Output DRAM (EDO DRAM), Burst Extended Data Output DRAM (REDO DRAM), Single Data Rate Synchronous DRAM (SDR SDRAM), Double Data Rate SDRAM (DDR SDRAM), Direct Rambus DRAM (DRDRAM), or Extreme Data Rate DRAM (XDR DRAM).

Memory can also refer to non-volatile storage technologies such as non-volatile read access memory (NVRAM), flash memory, non-volatile static RAM (nvSRAM), Ferroelectric RAM (FeRAM), Magnetoresistive RAM (MRAM), Phase-change memory (PRAM), conductive-bridging RAM (CBRAM), Silicon-Oxide-Nitride-Oxide-Silicon (SONOS), Resistive RAM (RRAM), Domain Wall Memory (DWM) or "Racetrack" memory, Nano-RAM (NRAM), or Millipede memory. Other non-volatile types of memory include optical disc memory (such as a DVD or CD ROM), a magnetically encoded hard disc or hard disc platter, floppy disc, tape, or cartridge media. The concept of a "memory" includes the use of any suitable storage technology or any combination of storage technologies.

"Message" generally refers to a discrete unit of communication intended by the source for consumption by some recipient or group of recipients. Both the source and the recipient may be a computer or other electronic circuitry configured to operate according to the contents of the data in messages sent and/or received. A message may be delivered by a computer network, by a transmitter and receiver via radio waves, over a communications link that uses a physical cable connecting ports in separate computers, or by any other suitable means. Examples of messages include electronic mail messages, Short Message Service (SMS) messages, or a collection of data fields with corresponding data field values. Examples of such a collection include messages encoded using a markup language such as Extensible Markup Language (XML) and passed over a computer network. Messages may include descriptive header fields describing the content or length of the message, or providing routing or other information. Messages may be divided into smaller units, transmitted, and reassembled for processing such as in the case of messages passed as one or more packets moving through a packet switched computer network.

"Microphone" generally refers to an acoustic-to-electric transducer or sensor that converts electromagnetic energy in the audible range (between about 20 and about 20,000 Hz) of the electromagnetic spectrum into an electrical signal.

A microphone may accomplish this conversion by any suitable means. For example, a microphone may use electromagnetic induction (dynamic microphones), capacitance change (condenser microphones) or piezoelectricity (piezoelectric microphones) to produce an electrical signal from air pressure variations. A microphone may be connected to a preamplifier, and then to an audio power amplifier and a speaker. A microphone may send the signal with or without amplification to a recording device which may record the signal in a digital or analog format.

Examples include telephones, hearing aids, public address systems for concert halls and public events, motion picture production, live and recorded audio engineering, two-way radios, megaphones, radio and television broadcasting, and in computers for recording voice, speech recognition, and for non-acoustic purposes such as ultrasonic imaging or testing.

"Mobile phone" as used herein is a specific example of a cellular device and is synonymous with the terms "cell phone" or "smart phone" all of which refer to a portable telephone which receives or makes calls through a cell of a cellular network. Mobile phones may thus be characterized as nodes in a communications link operating as an originating and/or final receiving node. A cell phone transmits to and receives from a cellular transceiver located in the cell (e.g. at a base unit or "cell tower.") Radio waves are generally used to transfer signals to and from the cell phone on a frequency that is specific (but not necessarily unique) to each cell. A mobile phone may be thought of, or may include, a computer, and may include memory, processor, display device, input/output devices, and so forth. A mobile phone may also be used as, and/or referred to as, a personal computing device.

"Module" or "Engine" generally refers to a collection of computational or logic circuits implemented in hardware, or to a series of logic or computational instructions expressed in executable, object, or source code, or any combination thereof, configured to perform tasks or implement processes. A module may be implemented in software maintained in volatile memory in a computer and executed by a processor or other circuit. A module may be implemented as software stored in an erasable/programmable nonvolatile memory and executed by a processor or processors. A module may be implanted as software coded into an Application Specific Information Integrated Circuit (ASIC). A module may be a collection of digital or analog circuits configured to control a machine to generate a desired outcome.

Modules may be executed on a single computer with one or more processors, or by multiple computers with multiple processors coupled together by a network. Separate aspects, computations, or functionality performed by a module may be executed by separate processors on separate computers, by the same processor on the same computer, or by different computers at different times.

"Motion Sensor" generally refers to a device configured to convert physical movement of an object into an electrical or signal. A motion sensor may be thought of as a transducer detecting physical movement and from it producing a time varying signal based on that movement. A motion sensor may operate by detecting changes in its position relative to other objects by emitting and/or detecting electromagnetic waves. Examples include ultrasonic, infrared, video, microwave, or other such motion detectors.

In another example, a motion sensor may operate by detecting changes in the magnitude and direction of proper acceleration caused by gravity ("g-force"). Sometimes called "accelerometers," these motion sensors can detect changes in g-forces on an object as a vector quantity, and can be used to sense changes in orientation (e.g. when the direction of weight changes), coordinate acceleration (e.g. when it produces g-force or a change in g-force), vibration, shock, and/or falling in a resistive medium. An accelerometer may thus be used to detect changes in the position, orientation, and movement of a device.

Commercially available accelerometers include piezoelectric, piezoresistive and capacitive components. Piezoelectric accelerometers may rely on piezoceramics (e.g. lead zirconate titanate) or single crystals (e.g. quartz, tourmaline). Piezoresistive accelerometers may be preferred in high shock applications. Capacitive accelerometers may use a silicon micro-machined sensing element.

A motion sensor may include multiple accelerometers. Some accelerometers are designed to be sensitive only in one direction. A motion sensor sensitive to movement in more than one direction may be constructed by integrating two accelerometers perpendicular to one another within a single package. By adding a third device oriented in a plan orthogonal to two other axes, three axes can be measured.

"Multiple" as used herein is synonymous with the term "plurality" and refers to more than one, or by extension, two or more.

"Network" or "Computer Network" generally refers to a telecommunications network that allows computers to exchange data. Computers can pass data to each other along data connections by transforming data into a collection of datagrams or packets. The connections between computers and the network may be established using either cables, optical fibers, or via electromagnetic transmissions such as for wireless network devices.

Computers coupled to a network may be referred to as "nodes" or as "hosts" and may originate, broadcast, route, or accept data from the network. Nodes can include any computing device such as personal computers, phones, servers as well as specialized computers that operate to maintain the flow of data across the network, referred to as "network devices". Two nodes can be considered "networked together" when one device is able to exchange information with another device, whether or not they have a direct connection to each other.

Examples of wired network connections may include Digital Subscriber Lines (DSL), coaxial cable lines, or optical fiber lines. The wireless connections may include BLUETOOTH, Worldwide Interoperability for Microwave Access (WiMAX), infrared channel or satellite band, or any wireless local area network (Wi-Fi) such as those implemented using the Institute of Electrical and Electronics Engineers' (IEEE) 802.11 standards (e.g. 802.11(a), 802.11 (b), 802.11(g), or 802.11(n) to name a few). Wireless links may also include or use any cellular network standards used to communicate among mobile devices including 1G, 2G, 3G, or 4G. The network standards may qualify as 1G, 2G, etc. by fulfilling a specification or standards such as the specifications maintained by International Telecommunication Union (ITU). For example, a network may be referred to as a "3G network" if it meets the criteria in the International Mobile Telecommunications-2000 (IMT-2000) specification regardless of what it may otherwise be referred to. A network may be referred to as a "4G network" if it meets the requirements of the International Mobile Telecommunications Advanced (IMTAdvanced) specification. Examples of cellular network or other wireless standards include AMPS, GSM, GPRS, UMTS, LTE, LTE Advanced, Mobile WiMAX, and WiMAX-Advanced.

Cellular network standards may use various channel access methods such as FDMA, TDMA, CDMA, or SDMA. Different types of data may be transmitted via different links and standards, or the same types of data may be transmitted via different links and standards.

The geographical scope of the network may vary widely. Examples include a body area network (BAN), a personal area network (PAN), a local-area network (LAN), a metropolitan area network (MAN), a wide area network (WAN), or the Internet.

A network may have any suitable network topology defining the number and use of the network connections. The network topology may be of any suitable form and may include point-to-point, bus, star, ring, mesh, or tree. A network may be an overlay network which is virtual and is configured as one or more layers that use or "lay on top of" other networks.

A network may utilize different communication protocols or messaging techniques including layers or stacks of protocols. Examples include the Ethernet protocol, the internet protocol suite (TCP/IP), the ATM (Asynchronous Transfer Mode) technique, the SONET (Synchronous Optical Networking) protocol, or the SDE1 (Synchronous Digital Elierarchy) protocol. The TCP/IP internet protocol suite may include application layer, transport layer, internet layer (including, e.g., IPv6), or the link layer.

"Output Device" generally refers to any device or collection of devices that is controlled by computer to produce an output. This includes any system, apparatus, or equipment receiving signals from a computer to control the device to generate or create some type of output. Examples of output devices include, but are not limited to, screens or monitors displaying graphical output, any projector a projecting device projecting a two-dimensional or three-is dimensional image, any kind of printer, plotter, or similar device producing either two-dimensional or three-dimensional representations of the output fixed in any tangible medium (e.g. a laser printer printing on paper, a lathe controlled to machine a piece of metal, or a three-dimensional printer producing an object). An output device may also produce intangible output such as, for example, data stored in a database, or electromagnetic energy transmitted through a medium or through free space such as audio produced by a speaker controlled by the computer, radio signals transmitted through free space, or pulses of light passing through a fiber-optic cable.

"Personal computing device" generally refers to a computing device configured for use by individual people. Examples include mobile devices such as Personal Digital Assistants (PDAs), tablet computers, wearable computers installed in items worn on the human body such as in eye glasses, laptop computers, portable music/video players, computers in automobiles, or cellular telephones such as smart phones. Personal computing devices can be devices that are typically not mobile such as desk top computers, game consoles, or server computers. Personal computing devices may include any suitable input/output devices and may be configured to access a network such as through a wireless or wired communications link.

"Port" generally refers to a physical or electronic interface between two separate circuits or devices. A port may include one or more electrical contacts configured to coincide with electrical contacts in a cable, the cable providing an electrical or electromagnetic communications link between circuits at each end of the cable, or at various points along the way. Cable connectors at the ends of a cable may be configured with electrical contacts or "pins" that coincide with pins in the physical port. Thus a port may be configured to accept a cable connector with a corresponding contact pin configuration (i.e. a "female" port), or may be configured with outwardly projecting pins (i.e. a "male" port) configured to fit into a female cable connector with a corresponding arrangement of pins.

Examples of ports include male and female Universal Serial Bus (USB) ports, Digital Visual Interface (DVI) ports, DisplayPort ports, Serial AT Attachment (SATA) ports, IEEE 1394 or "FireWire" ports, PS/2 ports, and Small Computer System Interface (SCSI) ports, to name a few.

"Processor" generally refers to one or more electronic components configured to operate as a single unit configured or programmed to process input to generate an output. Alternatively, when of a multi-component form, a processor may have one or more components located remotely relative to the others. One or more components of each processor may be of the electronic variety defining digital circuitry, analog circuitry, or both. In one example, each processor is of a conventional, integrated circuit microprocessor arrangement, such as one or more PENTIUM, i3, i5 or i7 processors supplied by INTEL Corporation of Santa Clara, Calif., USA. Other examples of commercially available processors include but are not limited to the X8 and Freescale Coldfire processors made by Motorola Corporation of Schaumburg, Ill., USA; the ARM processor and TEGRA System on a Chip (SoC) processors manufactured by Nvidia of Santa Clara, Calif., USA; the POWER7 processor manufactured by International Business Machines of White Plains, N.Y., USA; any of the FX, Phenom, Athlon, Sempron, or Opteron processors manufactured by Advanced Micro Devices of Sunnyvale, Calif., USA; or the Snapdragon SoC processors manufactured by Qalcomm of San Diego, Calif., USA.

A processor also includes Application-Specific Integrated Circuit (ASIC). An ASIC is an Integrated Circuit (IC) customized to perform a specific series of logical operations is controlling a computer to perform specific tasks or functions. An ASIC is an example of a processor for a special purpose computer, rather than a processor configured for general-purpose use. An application-specific integrated circuit generally is not reprogrammable to perform other functions and may be programmed once when it is manufactured.

In another example, a processor may be of the "field programmable" type. Such processors may be programmed multiple times "in the field" to perform various specialized or general functions after they are manufactured. A field-programmable processor may include a Field-Programmable Gate Array (FPGA) in an integrated circuit in the processor. FPGA may be programmed to perform a specific series of instructions which may be retained in nonvolatile memory cells in the FPGA. The FPGA may be configured by a customer or a designer using a hardware description language (HDL). In FPGA may be reprogrammed using another computer to reconfigure the FPGA to implement a new set of commands or operating instructions. Such an operation may be executed in any suitable means such as by a firmware upgrade to the processor circuitry.

Just as the concept of a computer is not limited to a single physical device in a single location, so also the concept of a "processor" is not limited to a single physical logic circuit or package of circuits but includes one or more such circuits or circuit packages possibly contained within or across multiple computers in numerous physical locations. In a virtual computing environment, an unknown number of physical processors may be actively processing data, the unknown number may automatically change over time as well.

The concept of a "processor" includes a device configured or programmed to make threshold comparisons, rules comparisons, calculations, or perform logical operations applying a rule to data yielding a logical result (e.g. "true" or "false"). Processing activities may occur in multiple single processors on separate servers, on multiple processors in a single server with separate processors, or on multiple processors physically remote from one another in separate computing devices.

"Proximity Sensor" generally refers to a sensor configured to generate a signal based on distance to a nearby object, or "target", generally without requiring physical contact. Lack of mechanical physical contact between the sensor and the sensed object provides the opportunity for extra reliability and long functional life.

A proximity sensor may emit an electromagnetic field or a beam of electromagnetic radiation (e.g. infrared light, for instance), and the sensor may determine proximity based on changes in the field or return signal. The object being sensed is often referred to as the "target" or "sensor target". Different proximity targets demand different sensors. For example, a capacitive or photoelectric sensor might be suitable for a plastic target; an inductive proximity sensor may require a metallic target.

The maximum distance that a proximity sensor can detect the target is defined as the sensor's "nominal range". A sensor may begin to emit a signal, or may change the signal already emitted when the distance from the target to the sensor exceeds the nominal range. Some sensors allow for adjustments to the nominal range, or may be configured to return an analog or digital time varying signal based on changes on the distance to the target in time.

"Receive" generally refers to accepting something transferred, communicated, conveyed, relayed, dispatched, or forwarded. The concept may or may not include the act of listening or waiting for something to arrive from a transmitting entity. For example, a transmission may be received without knowledge as to who or what transmitted it. Likewise the transmission may be sent with or without knowledge of who or what is receiving it. To "receive" may include, but is not limited to, the act of capturing or obtaining electromagnetic energy at any suitable frequency in the electromagnetic spectrum. Receiving may occur by sensing electromagnetic radiation. Sensing electromagnetic radiation may involve detecting energy waves moving through or from a medium such as a wire or optical fiber. Receiving includes receiving digital signals which may define various types of analog or binary data such as signals, datagrams, packets and the like.

"Rule" generally refers to a conditional statement with at least two outcomes. A rule may be compared to available data which can yield a positive result (all aspects of the conditional statement of the rule are satisfied by the data), or a negative result (at least one aspect of the conditional statement of the rule is not satisfied by the data). One example of a rule is shown below as pseudo code of an "if/then/else" statement that may be coded in a programming language and executed by a processor in a computer:

```
if(clouds.areGrey( ) and
(clouds.numberOfClouds>100)) then {
   Prepare for rain;
} else {
   Prepare for sunshine;
}
```

"Receiver" generally refers to a device configured to receive, for example, digital or analog signals carrying information via electromagnetic energy. A receiver using electromagnetic energy may operate with an antenna or antenna system to intercept electromagnetic waves passing through a medium such as air, a conductor such as a metallic cable, or through glass fibers. A receiver can be a separate piece of electronic equipment, or an electrical circuit within another electronic device. A receiver and a transmitter combined in one unit are called a "transceiver".

A receiver may use electronic circuits configured to filter or separate one or more desired radio frequency signals from all the other signals received by the antenna, an electronic amplifier to increase the power of the signal for further processing, and circuits configured to demodulate the information received.

Examples of the information received include sound (an audio signal), images (a video signal) or data (a digital signal). Devices that contain radio receivers include television sets, radar equipment, two-way radios, cell phones and other cellular devices, wireless computer networks, GPS navigation devices, radio telescopes, Bluetooth enabled devices, garage door openers, and/or baby monitors.

"Sensor" generally refers to a transducer configured to sense or detect a characteristic of the environment local to the sensor. For example, sensors may be constructed to detect events or changes in quantities or sensed parameters providing a corresponding output, generally as an electrical or electromagnetic signal. A sensor's sensitivity indicates how much the sensor's output changes when the input quantity being measured changes.

"Sense parameter" generally refers to a property of the environment detectable by a sensor. As used herein, sense parameter can be synonymous with an operating condition, environmental factor, sensor parameter, or environmental condition. Sense parameters may include temperature, air pressure, speed, acceleration, the presence or intensity of sound or light or other electromagnetic phenomenon, the strength and/or orientation of a magnetic or electrical field, and the like.

"Short Message Service (SMS)" generally refers to a text messaging service component of phone, Web, or mobile communication systems. It uses standardized communications protocols to allow fixed line or mobile phone devices to exchange short text messages. Transmission of short messages between a Short Message Service Center (SMSC) and personal computing device is done whenever using the Mobile Application Part (MAP) of the SS7 protocol. Messages payloads may be limited by the constraints of the signaling protocol to precisely 140 octets (140 octets*8 bits/octet=1120 bits). Short messages can be encoded using a variety of alphabets: the default GSM 7-bit alphabet, the 8-bit data alphabet, and the 16-bit UCS-2 alphabet. Depending on which alphabet the subscriber has configured in the handset, this leads to the maximum individual short message sizes of 160 7-bit characters, 140 8-bit characters, or 70 16-bit characters.

"Switch" or "Switching Device" generally refers to an electrical component that can break an electrical circuit. A switch may interrupt the current in the circuit, and/or divert the flow of current from one conductor electrically coupled to one circuit, to another separate conductor electrically coupled to a separate circuit. The mechanism of a switch may be operated directly by a human operator (e.g. turning on a light switch, pressing a keyboard button, or by moving a hand to break a beam of light), may be operated by one object moving adjacent to or relative to another object such as a door-operated switch, or may be operated by a sensor detecting changes in a sensed parameter such as pressure, temperature, magnetic or electrical field strength, and the like.

A switch may divert current from on conductor to another by any suitable means such as by physically moving a switching element contacting one conductor electrically coupled to a first circuit, to directly contact a different conductor electrically coupled to a second circuit. This may occur by physical mechanical means (e.g. one or more metal contacts moving inside a switch, relay, or contactor), or by changing the electrical properties of a material such as a semiconducting material to temporarily break and/or divert a flow of current. For example, a transistor may operate as a switch diverting the flow of electricity when a voltage or current applied to one pair of the transistor's terminals changes the current through another pair of terminals.

"Transmit" generally refers to causing something to be transferred, communicated, conveyed, relayed, dispatched, or forwarded. The concept may or may not include the act of conveying something from a transmitting entity to a receiving entity. For example, a transmission may be received without knowledge as to who or what transmitted it. Likewise the transmission may be sent with or without knowledge of who or what is receiving it. To "transmit" may include, but is not limited to, the act of sending or broadcasting electromagnetic energy at any suitable frequency in the electromagnetic spectrum. Transmissions may include digital signals which may define various types of binary data such as datagrams, packets and the like. A transmission may also include analog signals.

Information such as a signal provided to the transmitter may be encoded or modulated by the transmitter using various digital or analog circuits. The information may then be transmitted. Examples of such information include sound (an audio signal), images (a video signal) or data (a digital signal). Devices that contain radio transmitters include radar equipment, two-way radios, cell phones and other cellular devices, wireless computer networks and network devices, GPS navigation devices, radio telescopes, Radio Frequency Identification (RFID) chips, Bluetooth enabled devices, and garage door openers.

"Transmitter" generally refers to a device configured to transmit, for example, digital or analog signals carrying information via electromagnetic energy. A transmitter using electromagnetic energy may operate with an antenna or antenna system to produce electromagnetic waves passing through a medium such as air, a conductor such as a metallic cable, or through glass fibers. A transmitter can be a separate piece of electronic equipment, or an electrical circuit within another electronic device. A transmitter and a receiver combined in one unit are called a "transceiver".

"Triggering a Rule" generally refers to an outcome that follows when all elements of a conditional statement expressed in a rule are satisfied. In this context, a conditional statement may result in either a positive result (all conditions of the rule are satisfied by the data), or a negative result (at least one of the conditions of the rule is not satisfied by the data) when compared to available data. The conditions expressed in the rule are triggered if all conditions are met causing program execution to proceed along a different path than if the rule is not triggered.

"Viewing Area", "Field of View", or "Field of Vision" is the extent of the observable world that is seen at any given moment. In case of optical instruments, cameras, or sensors, it is a solid angle through which a detector is sensitive to electromagnetic radiation that includes light visible to the human eye, and any other form of electromagnetic radiation that may be invisible to humans.

The invention claimed is:

1. A system, comprising:
- a primary firearm;
- a holster configured to receive the primary firearm, the holster including a sensor target;
- a remote computer coupled to a communications network;
- a monitoring apparatus mounted to the primary firearm, including:
  - a sealed enclosure coupled to the primary firearm;
  - a camera inside the enclosure having a field of view extending outside the enclosure;
  - a microphone inside the enclosure responsive to sound received from outside the enclosure;
  - a proximity sensor inside the enclosure responsive to the sensor target in the holster;
  - a motion sensor inside the enclosure;
  - a network interface inside the enclosure configured to send messages to the remote computer using the communications network; and
  - a controller inside the enclosure, the controller coupled to the camera, microphone, proximity sensor, motion sensor, and network interface, wherein the controller includes control logic configured to:
    - activate the camera, microphone, and motion sensor when the proximity sensor senses the sensor target;
    - determine a first firearm has been discharged based on motion sensor input from the motion sensor;
    - determine a second firearm has been discharged based on audio input from the microphone; and
    - send a first report message to the remote computer using the network interface when the control logic determines that the first firearm is a different firearm than the second firearm.

2. The system of claim 1, wherein the first firearm is the primary firearm, and the second firearm is not the primary firearm.

3. The system of claim 1, the primary firearm comprising:
- a frame assembly including a grip at a first end extending to a second end opposite the grip;
- wherein the monitoring apparatus is mounted to the frame assembly at about the second end of the frame assembly.

4. The system of claim 1, the monitoring apparatus comprising:
- a memory inside the enclosure;
- a port coupled to the controller and configured to establish a communications link with the remote computer;
- wherein the control logic is configured to:
  - store one or more images received from the camera into the memory; and
  - transfer at least a portion of the one or more images in the memory to the remote computer by sending one or more messages to the remote computer using the communications link.

5. The system of claim 1, the monitoring apparatus, wherein the control logic is configured to send a second report message to the remote computer that is different than the first report message, using the network interface, when the control logic determines that the first firearm and the second firearm are the primary firearm.

6. The system of claim 1, the monitoring apparatus comprising:
- a location sensing device inside the sealed enclosure and in communication with the control logic, the location sensing device configured to determine a location of the primary firearm;
- wherein the control logic is configured to:
  - send one or more messages to the remote computer that include the location of the primary firearm.

7. The system of claim 1, the monitoring apparatus comprising:
- a lamp inside the sealed enclosure, the lamp projecting light outside the enclosure;
- wherein at least a portion of the light projected by the lamp is projected into the field of view of the camera.

8. A monitoring apparatus, comprising:
- an enclosure having a mount configured to couple the enclosure to a primary firearm;
- a camera mounted in the enclosure;
- a microphone mounted in the enclosure;
- a motion sensor mounted in the enclosure; and a controller in the enclosure, the controller including control logic responsive to the camera, microphone, and motion sensor;

wherein the control logic is configured to:

determine a first firearm has been discharged based on motion sensor input from the motion sensor;

determine a second firearm has been discharged based on audio input from the microphone;

determine that the first firearm is the primary firearm based on the motion sensor input, and that the second firearm is not the primary firearm based on the audio input from the microphone, wherein the monitoring apparatus is coupled to the primary firearm;

send a report message to a remote computer using a network interface when the control logic determines that the first firearm is a different firearm than the second firearm.

9. The monitoring apparatus of claim 8, comprising:

a proximity sensor in the enclosure, the proximity sensor responsive to a sensor target in a holster, wherein the holster is configured to receive the primary firearm; wherein the control logic is configured to:

activate the camera, microphone, and motion sensor when the proximity sensor senses the sensor target as the primary firearm is removed from the holster; and deactivate the camera, microphone, and motion sensor when the proximity sensor senses the sensor target as the primary firearm is placed in the holster.

10. The monitoring apparatus of claim 8, the primary firearm comprising:

a frame assembly with a first end and a second end opposite the first end; and a sealed enclosure mounted to the frame assembly at about the second end, the sealed enclosure containing the camera, motion sensor, microphone, and controller.

11. The monitoring apparatus of claim 8, comprising:

a location sensing device in communication with the control logic, the location sensing device configured to determine a location of the primary firearm.

12. The monitoring apparatus of claim 8, comprising:

a lamp projecting light into at least a portion of a field of view defined by the camera.

13. The monitoring apparatus of claim 8, wherein the controller is configured to send a message to a remote computer using a communications link between the remote computer and the controller when the control logic determines that the first firearm is the primary firearm, and the second firearm is not the primary firearm.

14. The monitoring apparatus of claim 13, comprising:

a memory in communication with the control logic;

wherein the control logic is configured to:

store one or more images received from the camera in the memory when the camera is activated; and transfer the one or more images from the memory to the remote computer by sending one or more messages to the remote computer using a communications link between the monitoring apparatus and the remote computer.

15. The monitoring apparatus of claim 13, comprising:

a communication port coupled to the controller and configured to communicate with the remote computer;

a power port configured to receive power from outside the enclosure.

16. The monitoring apparatus of claim 15, wherein the communications port and the power port are the same port.

17. A method, comprising:

determining that a primary firearm has been withdrawn from a holster configured to accept the primary firearm using a proximity sensor coupled to a controller, the proximity sensor responsive to a sensor target, wherein the proximity sensor is mounted to the primary firearm and the sensor target is mounted to the holster, and wherein the controller receives a signal from the proximity sensor when it passes adjacent to the sensor target;

activating a camera, microphone, and motion sensor mounted to the primary firearm and coupled to the controller, wherein the controller activates the camera, microphone, and motion sensor when the controller determines that the primary firearm has been withdrawn from the holster;

using the controller to determine that a first firearm has been discharged based on input to the controller that is received from the motion sensor;

using the controller to determine that a second firearm has been discharged based on input received from the microphone;

sending a message to a remote computer using a communications link between the controller and the remote computer when the controller determines that the first firearm is the primary firearm, and the second firearm is not the primary firearm.

18. The method of claim 17, comprising:

storing one or more images received from the camera in a memory using the controller; and transferring the one or more images from the memory to the remote computer by sending one or more messages to the remote computer using the controller, wherein the controller sends the messages to the remote computer using the communications link.

19. The method of claim 17, comprising:

activating a location sensing system mounted to the primary firearm using the controller;

sensing a location of the primary firearm using the controller, wherein the controller receives location information from the location sensing system; and sending at least a portion of the location information along with the message sent to the remote computer.

20. The method of claim 19, comprising:

receiving messages in the remote computer using a communications module, the messages sent from the controller;

processing the location information in the messages received by the remote computer using a geo-location module in the remote computer; and generating a user interface on a display device using a user interface module in the remote computer, the user interface module configured to generate a map with indicia on the map indicating the location of the primary firearm;

wherein the indicia on the map includes indicia at a location on the map corresponding to the location information received by the remote computer.

* * * * *